US012788205B2

(12) United States Patent
Beninato et al.

(10) Patent No.: US 12,788,205 B2
(45) Date of Patent: Nov. 10, 2026

(54) WASHING APPLIANCE WITH IMPROVED CIRCULATION PUMP CONTROL

(71) Applicant: ELECTROLUX APPLIANCES AKTIEBOLAG, Stockholm (SE)

(72) Inventors: Daniele Beninato, Porcia (IT); Riccardo Prota, Porcia (IT); Sandro Brovedani, Porcia (IT); Alberto Bisutti, Porcia (IT); Viktor Kozma, Porcia (IT); Arne Nensen, Stockholm (SE); David Persson, Stockholm (SE); Conny Finne, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 190 days.

(21) Appl. No.: 18/720,415

(22) PCT Filed: Dec. 22, 2021

(86) PCT No.: PCT/EP2021/087402
§ 371 (c)(1),
(2) Date: Jun. 14, 2024

(87) PCT Pub. No.: WO2023/117092
PCT Pub. Date: Jun. 29, 2023

(65) Prior Publication Data

US 2025/0049284 A1 Feb. 13, 2025

(51) Int. Cl.
*A47L 15/00* (2006.01)
*A47L 15/42* (2006.01)
*A47L 15/46* (2006.01)

(52) U.S. Cl.
CPC ..... *A47L 15/0023* (2013.01); *A47L 15/4225* (2013.01); *A47L 15/46* (2013.01);
(Continued)

(58) Field of Classification Search
CPC .. A47L 15/0023; A47L 15/4225; A47L 15/46; A47L 2301/04; A47L 2501/01;
(Continued)

(56) References Cited

U.S. PATENT DOCUMENTS 4,227,546 A * 10/1980 Bergeson ..... A47L 15/4219 134/58 D
5,669,983 A * 9/1997 Cooper ..... A47L 15/0031 134/25.1
(Continued)

FOREIGN PATENT DOCUMENTS

EP 2806062 A1 * 11/2014 ..... D06F 39/022
IT 20111248 A1 7/2013

OTHER PUBLICATIONS

Patent Cooperation Treaty, International Patent Application No. PCT/EP/2021/087402, "International Search Report," Sep. 5, 2022, 6 pages.
(Continued)

*Primary Examiner* — Benjamin L Osterhout
(74) *Attorney, Agent, or Firm* — Chrisman Gallo Tochtrop LLC

(57) ABSTRACT

A washing appliance includes a tub; an inlet valve operable to be selectively switched between an open condition for causing washing fluid to be loaded into the tub and a closed condition for preventing washing fluid be fed to the appliance; a circulation pump configured to circulate the washing fluid in the tub; and a control unit configured to determine an operative state of the circulation pump between a saturation state and a starvation state The control unit is further configured to cause a speed of the circulation pump to increase towards the target speed from a first speed increase rate to a second speed increase rate if the following two conditions a) and b) are both true: a) the starvation state of the circulation pump is determined before the speed of the
(Continued)

circulation pump reaches the target speed, and b) the inlet valve is in the open condition.

20 Claims, 12 Drawing Sheets

(52) U.S. Cl.
CPC ..... *A47L 15/4214* (2013.01); *A47L 2301/04* (2013.01); *A47L 2401/08* (2013.01); *A47L 2401/09* (2013.01); *A47L 2401/30* (2013.01); *A47L 2501/01* (2013.01); *A47L 2501/05* (2013.01)

(58) Field of Classification Search
CPC ..... A47L 2501/05; A47L 2401/08; A47L 2401/09; A47L 2401/30; A47L 15/4214

See application file for complete search history.

(56) References Cited

U.S. PATENT DOCUMENTS

| | | | | |
|---|---|---|---|---|
| 2005/0005952 | A1 | 1/2005 | Bashark | |
| 2009/0194141 | A1* | 8/2009 | Nagel | F16K 3/04 134/186 |
| 2009/0205680 | A1 | 8/2009 | Bragg | |
| 2010/0186772 | A1 | 7/2010 | Hatfield et al. | |
| 2014/0124005 | A1 | 5/2014 | Ugel et al. | |
| 2014/0158163 | A1* | 6/2014 | Montgomery | A47L 15/0002 210/791 |
| 2014/0259448 | A1* | 9/2014 | Alexander | D06F 35/005 68/12.18 |
| 2017/0347855 | A1 | 12/2017 | Persson | |
| 2018/0310798 | A1 | 11/2018 | Persson | |

OTHER PUBLICATIONS

Patent Cooperation Treaty, International Patent Application No. PCT/EP/2021/087402, "Written Opinion of the International Searching Authority," Sep. 5, 2022, 13 pages.

* cited by examiner

WASHING APPLIANCE WITH IMPROVED CIRCULATION PUMP CONTROL

CROSS-REFERENCE TO RELATED APPLICATIONS

This application is a national stage under 35 U.S.C. § 371 of International Application No. PCT/EP2021/087402, filed Dec. 22, 2021, the entire disclosure of which is incorporated by reference herein.

FIELD OF THE INVENTION

The solutions according to embodiments of the present invention relate to the field of washing appliances. More particularly, the embodiments of the present invention relates to a dishwasher.

BACKGROUND OF THE INVENTION

A dishwasher is a washing appliance configured to wash items such as dishes, cutlery, drinking glasses.

A conventional dishwasher comprises a tub configured to house the items to be washed, and a sump in fluid communication with a bottom portion of the tub. The sump is configured to collect a washing fluid reaching the tub and detergent discharged from a detergent compartment.

A conventional dishwasher further comprises a circulation pump in fluid communication with the sump (and, hence, with the tub), and configured to circulate the washing fluid in the tub. Particularly, when the circulation pump is rotated in a predefined direction, the washing fluid leaves the sump and re-enters the tub by means of proper spray devices.

A conventional dishwasher further comprises an inlet valve operable to selectively cause new washing fluid (e.g., fresh water provided by a water inlet) be loaded into the tub.

A conventional dishwasher further comprises a drain pump configured to selectively cause washing fluid in the sump to be drained from the dishwasher, for example through a corresponding drain outlet.

These components of a conventional dishwasher are properly driven based on phases of an, e.g., user-selected, washing cycle, being carried out by the dishwasher.

Reliably determining (e.g., an indication of) the actual level of washing fluid inside the tub is of the upmost importance to ensure correct operation of the dishwasher when the abovementioned components of a conventional dishwasher are being driven.

For this purpose, conventional dishwashers are provided with a dedicated sensor configured to determine the level of washing fluid in the tub, such as for example a pressure sensor.

SUMMARY OF THE INVENTION

Applicant has found that the known solutions implemented in conventional dishwasher providing for exploiting a dedicated sensor configured to determine the level of washing fluid in the tub are not satisfactory, being affected by drawbacks.

Installing a dedicated sensor is indeed costly, not only because of the cost of the sensor itself, but also because the sensor need to be properly installed in the dishwasher, such as at the sump thereof.

Moreover, in order to properly operate, a fluid level sensor need to be suitably supplied with electric power, and be capable of exchanging data with a control unit of the dishwasher. For these reasons, a sensor of this kind requires the installation of proper wirings.

Furthermore, since the inside of a dishwasher is a harsh environment, in which hot water, bubbles, and soil particles are present, a fluid level sensor is subjected to serious wear during the operation of the dishwasher. Therefore, in order to preserve the correct operation of the fluid level sensor, the latter should be subjected to inspection and maintenance operations with a not negligible frequency.

In view of the above, Applicant has devised a dishwasher capable of reliably operating without requiring the presence of a dedicated fluid level sensor.

An aspect of the present invention relates to a washing appliance comprising a tub configured to house items to be washed.

The washing appliance further comprises an inlet valve operable to be selectively switched between an open condition for causing washing fluid to be loaded into the tub and a closed condition for preventing washing fluid be fed to the appliance.

The washing appliance further comprises a circulation pump configured to circulate the washing fluid in the tub during a washing cycle.

The washing appliance further comprises a control unit configured to determine an operative state of the circulation pump between a saturation state indicative that sufficient washing fluid is present in the tub to prevent air from being drawn out by the circulation pump, and a starvation state indicative that insufficient washing fluid is present in the tub to prevent air from being drawn out by the circulation pump.

The control unit is further configured to receive an indication of a target speed for the circulation pump and accordingly control the circulation pump by:

causing a speed of the circulation pump to increase towards the target speed with a first speed increase rate;

if the following two conditions a) and b) are both true;

a) a starvation state of the circulation pump is determined before the speed of the circulation pump reached the target speed, and b) the inlet valve is in the open condition, causing the speed of the circulation pump to increase towards the target speed with a second speed increase rate lower than the first speed increase rate.

By exploiting the determination of the operative state of the circulation pump (saturation state or starvation state), it is advantageously possible to efficiently control the current speed of the circulation pump to reach a value corresponding to a requested target speed without requiring the presence of a pressure sensor for the determination of the level of washing fluid currently inside the tub.

Applicant has verified that using the determined operative state of the circulation pump for controlling the speed of the circulation pump is more efficient than carrying out a circulation pump speed control based on the output of a fluid level sensor, and is more precise, especially in case of modern dishwashers having a sump of reduced size for environmental purposes.

Furthermore, the peculiar control of the circulation pump according to the embodiments of the present invention advantageously allows to reach a desired target speed for the circulation pump in a reduced time. Indeed, even if a starvation state of the circulation pump is determined before the speed of the circulation pump reached the target speed, meaning that the amount of washing fluid in the tub may be insufficient for guaranteeing a correct operation of the dishwasher with the current speed of the circulation pump, the speed of the circulation pump is not decreased, but rather is still increased (although at a reduced increase rate) towards the target speed if the inlet valve is open, since the possibly insufficient level of washing fluid inside the tub may be compensated by new washing fluid provided into the tub through the inlet valve.

According to an embodiment of the present invention, the control unit is configured to cause the speed of the circulation pump to decrease if the condition a) is true while condition b) is not true.

In this case, since no new washing fluid is being fed into the tub through the inlet valve, the current speed of the circulation pump is reduced, in order to promote a saturation state of the circulation pump indicative of a condition in which the amount of washing fluid inside the tub is sufficient for a correct operation of the circulation pump at the reduced speed.

According to an embodiment of the present invention, the control unit is configured to cause the speed of the circulation pump to increase towards the target speed with the second speed increase rate if, in addition to have both the conditions a) and b) that are true, no saturation state of the circulation pump is determined during a predetermined time period after the determination of a starvation state of the circulation pump.

According to an embodiment of the present invention, the control unit is configured to cause the speed of the circulation pump increase towards the target speed with a third speed increase rate lower than the first speed increase rate and higher than the second speed increase rate if the speed of the circulation pump reached the target speed before a starvation state of the circulation pump is determined.

According to an embodiment of the present invention, the control unit is configured to cause the speed of the circulation pump increase towards the target speed with the third speed increase rate if, in addition to have the condition a) true, a saturation state of the circulation pump is determined during said predetermined time period.

In this way, if—after a starvation state of the circulation pump is detected—a saturation state of the circulation pump is detected again, the increase rate for the speed of the circulation pump is advantageously set to a value higher than the second speed increase rate, because the current level of washing fluid in the tub is sufficient for a correct operation of the circulation pump at a higher speed.

According to an embodiment of the present invention, said third speed increase rate is equal to a first value if the inlet valve is in the open condition, and is equal to a second value lower than the first value if the inlet valve is in the closed condition.

In this way, the speed of the circulation pump is advantageously controlled based on the amount of washing fluid that will be available inside the tub determined by the condition of the inlet valve.

According to an embodiment of the present invention, said target speed depends on a user-selected washing cycle being carried out by the washing appliance and/or by a phase of said user-selected washing cycle being carried out by the washing appliance.

In this way, the speed of the circulation pump is advantageously controlled to reach a value that is suitable to the specific phase/washing cycle being carried out.

According to an embodiment of the present invention, said first speed increase rate is higher than 70 RPM/s.

According to an embodiment of the present invention, said second speed increase rate is lower than 10 RPM/s.

According to an embodiment of the present invention, said first value of the third speed increase rate is higher than 50 RPM/s.

According to an embodiment of the present invention, said second value of the third speed increase rate is lower than 50 RPM/s.

According to an embodiment of the present invention, the washing appliance is a dishwasher.

According to an embodiment of the present invention, the dishwasher comprises at least one basket provided in the tub for accommodating the items to be washed.

According to an embodiment of the present invention, the dishwasher comprises a set of spray devices for receiving washing fluid from the circulation pump and for accordingly spray received washing fluid into the tub.

Another aspect of the present invention relates to a washing appliance comprising a tub configured to house items to be washed.

The washing appliance comprises a sump in fluid communication with the tub for collecting washing fluid from the tub.

The washing appliance further comprises a circulation pump in fluid communication with the sump and configured to circulate the washing fluid in the tub during a washing cycle when the circulation pump is controlled to rotate in a first direction.

The washing appliance further comprises a drain pump configured to be operated in an activated condition for causing washing fluid in the sump to be drained from the washing appliance and in a deactivated condition for preventing washing fluid in the sump to be drained from the washing appliance.

The washing appliance further comprises a control unit configured to control the draining of washing fluid from the sump by carrying out the following sequence of operations:

- cause the drain pump to switch from the deactivated condition to the activated condition;
- control the circulation pump to rotate in a second direction opposite to the first direction;
- collect samples of an electromechanical parameter of the circulation pump while rotating in the second direction;
- carry out a comparison between said collected samples and a threshold;
- determine an empty condition of the sump in which the sump substantially does not contain washing fluid based on said comparison.

In this way, it is possible to determine an empty condition of the sump without requiring the presence of a pressure sensor for the determination of the current level of washing fluid inside the tub.

According to an embodiment of the present invention, the control unit is configured to calculate an energy value indicative of an electrical energy consumed by the circulation pump while rotating in the second direction based on said collected samples, the control unit being configured to carry out said comparison between said collected samples and the threshold by comparing said calculated energy value with said threshold.

Determining an empty condition of the sump through an energy value indicative of an electrical energy consumed by the circulation pump is a very efficient solution, since it provides for a precise outcome without requiring additional devices to be installed inside the sump.

According to an embodiment of the present invention, the control unit is configured to calculate said energy value by summing the collected samples According to an embodiment of the present invention, the control unit is further configured to initialize a counter to a starting counter value upon the drain pump switches from the deactivated condition to the activated condition, and then carry out the following sequence of operations d), e), f):

d) collect a set of said samples;

e) calculate said energy value based on said set of collected samples;

f) carry out said comparison between said calculated energy value and the threshold.

According to an embodiment of the present invention, the control unit is further configured to carry out the following operations if said calculated energy value is equal to or lower than the threshold:

update the value of the counter, if the value of the counter reaches or trespasses a counter threshold, determine said empty condition of the sump;

if the value of the counter does not reach or does not trespass said counter threshold, reiterate the sequence of operations d), e), f) by collecting a new set of said samples.

Through this counter, an improved determination of an empty condition of the sump can be obtained. When the counter reaches or trespasses a counter threshold, it means that the calculated energy value has been determined to be lower than the threshold for a number of times in a row sufficient to discard incorrect determinations of empty conditions of the sump due to spurious variations of the speed of the circulation pump (independent from the actual level of the washing fluid inside the sump).

According to an embodiment of the present invention, the control unit is further configured to reset the counter to the starting counter value, and reiterating the sequence of operations d), e), f) by collecting a new set of said samples if said calculated energy value is higher than the threshold.

According to an embodiment of the present invention, the control unit is configured to deactivate the circulation pump, and then reactivate the circulation pump to rotate in the second direction before a new reiteration of the sequence of operations d), e), f).

According to an embodiment of the present invention, the control unit is configured to determine said empty condition of the sump if, in addition to have said calculated energy value that is equal to or lower than the threshold, and in addition to have said value of the counter that reaches or trespasses the counter threshold, the calculated energy value is also higher than a minimum energy threshold.

In this way, it is possible to advantageously identify (and therefore, discard) cases in which the energy consumption of the circulation pump is at a value that is not sufficiently low and stable to avoid incorrect determinations of empty conditions of the sump.

According to an embodiment of the present invention, the control unit is further configured to update said minimum energy threshold at each reiteration of the sequence of operations d), e), f) based on the energy value calculated at said reiteration.

According to an embodiment of the present invention, the control unit is configured to cause the drain pump to switch from the activated condition to the deactivated condition when said empty condition of the sump has been determined.

Thanks to this solution, it is therefore possible to empty the sump (and therefore the tub) and turning off the drain pump when the empty condition of the sump is determined, without requiring the presence of a pressure sensor for the determination of the current level of washing fluid inside the tub.

According to an embodiment of the present invention, said electromechanical parameter of the circulation pump is at least one among:

an electric current drawn by the circulation pump;

a voltage across the circulation pump;

an electric power consumed by the circulation pump;

a torque of the circulation pump.

A solution providing for measuring said electromechanical parameters of the circulation pump is more efficient and reliable compared to one requiring the installation of a dedicated fluid level sensor inside the sump.

According to an embodiment of the present invention, the washing appliance is a dishwasher.

According to an embodiment of the present invention, the dishwasher comprises at least one basket provided in the tub for accommodating the items to be washed.

According to an embodiment of the present invention, the dishwasher comprises a set of spray devices for receiving washing fluid from the circulation pump and for accordingly spray received washing fluid into the tub.

Another aspect of the present invention relates to a washing appliance comprising a tub configured to house items to be washed.

The washing appliance further comprises a circulation pump configured to circulate the washing fluid in the tub during a washing cycle.

The washing appliance further comprises a drain pump configured to be operated in an activated condition for causing washing fluid in the tub to be drained from the washing appliance and in a deactivated condition for preventing washing fluid in the tub to be drained from the washing appliance.

The washing appliance further comprises a control unit configured to determine an operative state of the circulation pump between a saturation state indicative that sufficient washing fluid is present in the tub to prevent air from being drawn out by the circulation pump, and a starvation state indicative that insufficient washing fluid is present in the tub to prevent air from being drawn out by the circulation pump.

The control unit is further configured to receive an indication of a current speed of the circulation pump and an indication of a target speed for the circulation pump.

Said target speed is based on a user-selected washing cycle and/or on a phase of said user-selected washing cycle.

The control unit is further configured to accordingly control the drain pump by:

causing the drain pump to switch from the deactivated condition to the activated condition if the two following conditions g) and h) are both true:

g) a saturated state of the circulation pump is determined, and h) said current speed of the circulation pump is equal to or higher than said target speed.

By exploiting the determination of the operative state of the circulation pump (saturation state or starvation state), it is advantageously possible to efficiently carry out partial drains of washing fluid without requiring the presence of a pressure sensor for the determination of the current level of washing fluid inside the tub. The partial drains of washing fluid are advantageously carried out by efficiently control the drain of amounts of washing fluid from the tub (and from the dishwasher) dosed in such a way to allow a correct operation of the dishwasher when the latter is operating with the circulation pump at a circulation pump speed based on said target speed. Indeed, drain of the washing fluid is triggered when the amount of washing fluid inside the tube is sufficiently large to allow the circulation pump to operate at the target speed (or even faster) while remaining in saturation.

According to an embodiment of the present invention, the control unit is further configured to control the drain pump by causing the drain pump to switch from the activated condition to the deactivated condition if a starvation state of the circulation pump is determined.

In this way, the draining of washing fluid is advantageously ended when the current level of washing fluid inside the tub reached a level so low to cause a starvation of the circulation pump.

According to an embodiment of the present invention, the control unit is further configured to control the drain pump by causing the drain pump to switch from the activated condition to the deactivated condition if in addition to have the condition g) that is true, the condition h) is not true.

In this way, the draining of washing fluid is advantageously ended when the current level of washing fluid inside the tub is sufficiently high to cause saturation of the circulation pump when the latter is operating at a speed that is still lower than the target speed.

According to an embodiment of the present invention, said target speed depends on a user-selected washing cycle being carried out by the washing appliance and/or by a phase of said user-selected washing cycle being carried out by the washing appliance.

In this way, the speed of the circulation pump is advantageously controlled to reach a value that is suitable to the specific phase/washing cycle being carried out.

According to an embodiment of the present invention, the washing appliance is a dishwasher.

According to an embodiment of the present invention, the washing appliance comprises at least one basket provided in the tub for accommodating the items to be washed.

According to an embodiment of the present invention, the washing appliance comprises a set of spray devices for receiving washing fluid from the circulation pump and for accordingly spray received washing fluid into the tub.

BRIEF DESCRIPTION OF THE ANNEXED DRAWINGS

These and other features and advantages of the present invention will be made apparent by the following description of some exemplary and non limitative embodiments thereof: for its better intelligibility, the following description should be read making reference to the attached drawings, wherein:

FIG. 1 schematically illustrates a dishwasher in which concepts according to embodiments of the present invention can be applied, FIG. 2 illustrates in terms of functional blocks some of the routines that can be carried out by a control unit of the dishwasher of FIG. 1 for controlling the operations of said dishwasher according to an embodiment of the present invention:

DETAILED DESCRIPTION OF PREFERRED EMBODIMENTS OF THE INVENTION

Figure 1:
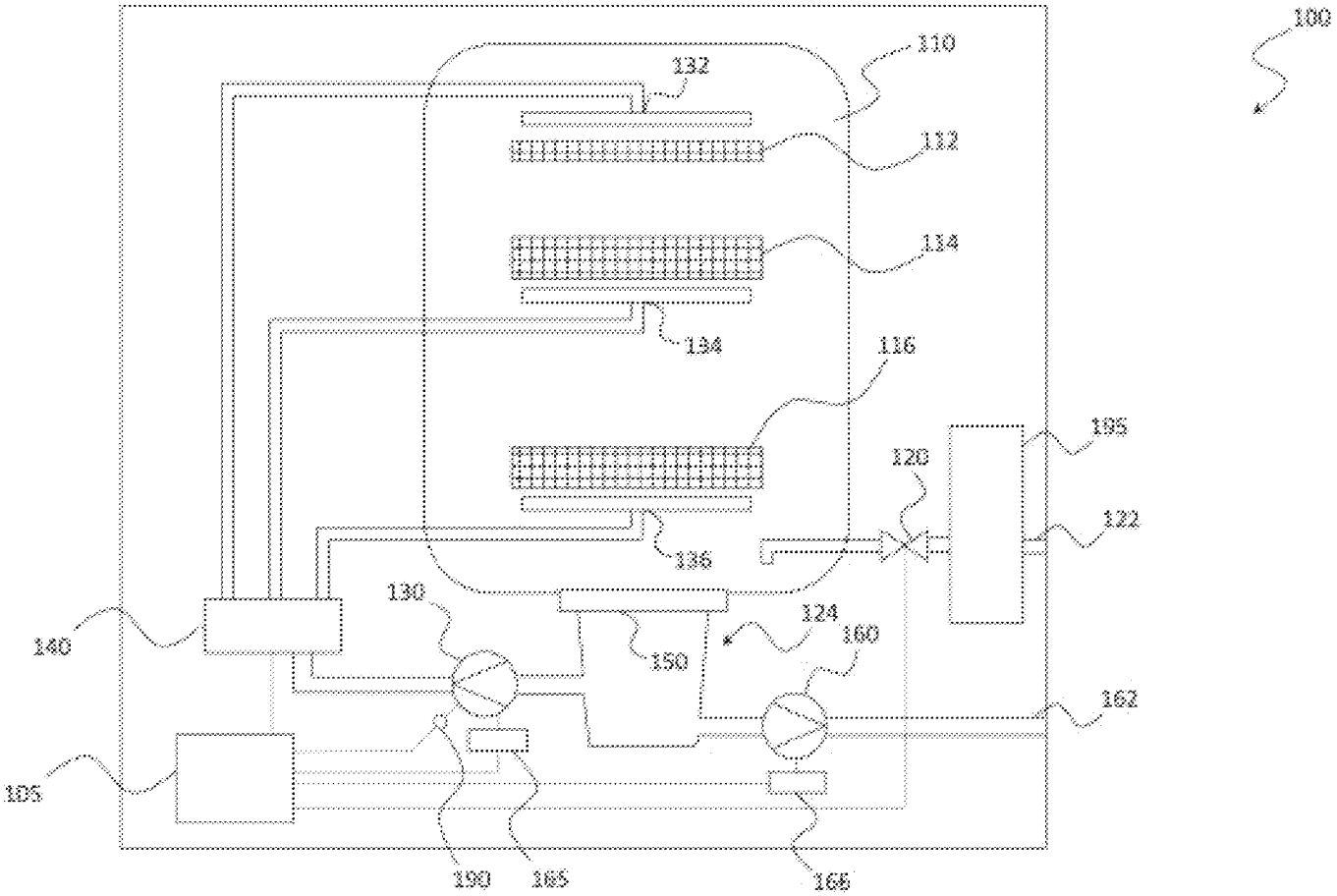

With reference to the drawings, FIG. 1 schematically illustrates a simplified (not-in-scale) cross-sectional side view of a washing appliance 100 in which concepts according to the embodiments of the present invention can be applied. According to the embodiment of the invention illustrated in FIG. 1, the washing appliance 100 is a dishwasher.

The dishwasher 100 comprises a number of well known hydraulic, electronic, electric and electromechanical components—however, for the sake of description ease and conciseness, only those being relevant for understanding the invention will be introduced and discussed in the following. The operation of these (not illustrated) electronic, electric and electromechanical components of the dishwasher 100 is controlled by one or more control units (only one illustrated in FIG. 1 and identified with reference 105).

According to an embodiment of the present invention, the dishwasher 100 comprises a tub 110 configured to house items to be washed, such as dishes, cutlery, drinking glasses.

According to an embodiment of the present invention one or more baskets are provided in the tub 110 for accommodating the items to be washed. In the exemplary embodiment of the invention illustrated in FIG. 1, the tub 110 is provided with a first, upper, basket 112, a second, middle, basket 114 and a third, lower, basket 116. For example, the first basket 112 may be configured to accommodate cutlery, and the second and third baskets 114, 116 may be configured to accommodate other kinds of items to be washed, such as plates and drinking glasses.

According to an embodiment of the present invention, a door (not shown in the figure) is hingedly mounted to a front portion of the dishwasher 100 to provide selective access to the tub 110, and accordingly to the baskets 112, 114, 116.

According to an embodiment of the present invention, detergent in the form of tablets, liquid, or powder is stored in a corresponding detergent compartment located at an inside portion of the door (not shown) of the dishwasher 100. According to an embodiment of the present invention, said stored detergent is controllably discharged, under the control of the control unit 105, into the tub 110 according to user-selected washing cycle being carried out by the dishwasher 100 and/or by a phase of said user-selected washing cycle being carried out by the dishwasher 100.

According to an embodiment of the present invention, the dishwasher 100 comprises an inlet valve 120 operable by the control unit 105 to be selectively switched between an open condition for causing washing fluid (e.g., fresh water provided by a water inlet 122) to be loaded into the tub 110 and a closed condition for preventing washing fluid be fed to the dishwasher 100.

According to an embodiment of the present invention, the dishwasher 100 comprises a sump, globally identified in FIG. 1 with reference 124, in fluid communication with a bottom portion of the tub 110, so that washing fluid reaching the tub 110—such as fresh water loaded by the inlet valve 120—is collected in said sump 124. Fresh water collected in the sump 124 is also mixed therein with the detergent discharged from the detergent compartment, so that the resulting washing fluid—also referred to as process water—turns into a mixture of water and detergent.

According to an embodiment of the present invention, the dishwasher 100 further comprises a circulation pump 130 in fluid communication with the sump 124—and therefore with the tub 110—and configured to circulate the washing fluid in the tub 110 during a user-selected washing cycle being carried out by the dishwasher 100 and/or by a phase of said user-selected washing cycle being carried out by the dishwasher 100. According to an embodiment of the present invention, the circulation pump 130 is configured to circulate the washing fluid in the tub 110 when the circulation pump 130 is controlled by the control unit 105 to rotate in a first, forward, direction.

According to an embodiment of the present invention, when the circulation pump 130 is controlled to rotate in the forward direction, washing fluid leaves the sump 124 and re-enter in the tub 110 from above. Particularly, according to an embodiment of the present invention, the washing fluid taken from the sump 124 is pumped by the circulation pump 130 through one or more conducts and sprayed back into the tub 110 by spray devices 132, 134, 136 each one associated with a respective basket 112, 114, 116. According to an embodiment of the present invention, each spray device 132, 134, 136 comprises a respective wash arm provided with nozzles for causing washing fluid being sprayed onto the items to be washed housed in the respective basket 112, 114, 116.

According to an embodiment of the present invention, the dishwasher 100 advantageously comprises a flow control device 140 configured to receive the washing fluid pumped by the circulation pump 130 when the latter is controlled to rotate in the forward direction, and to connect—under the control of the control unit 105—one or more selected spray device(s) 132, 134, 136 to the circulation pump 130 in order to provide the washing fluid received by the circulation pump 130 to said selected spray device(s) 132, 134, 136. In this way, the washing fluid pumped by the circulation pump 130 may be selectively recirculated in the washing tub 110 through one or more selected spray device(s) 132, 134, 136.

According to an embodiment of the present invention, a filter 150 is advantageously provided at the sump 124 for filtering soil from the washing fluid before the latter is recirculated into the washing tub 110 by the circulation pump 130 through the spray device(s) 132, 134, 136.

According to an embodiment of the present invention, the dishwasher 100 further comprises a drain pump 160 configured to be operated by the control unit 105 in an activated condition for causing washing fluid in the sump 124 to be drained from the dishwasher 100, e.g., through a corresponding drain outlet 162, and in a deactivated condition for preventing washing fluid in the sump 124 to be drained from the dishwasher 100.

According to the exemplary embodiment of the present invention illustrated in FIG. 1, the circulation pump 130 is driven by a corresponding motor system 165 (for example comprising a respective electric motor driven by a respective motor driving unit comprising a respective inverter and a TRIAC) controlled by the control unit 105.

Similarly, according to the exemplary embodiment of the present invention illustrated in FIG. 1, the drain pump 160 is driven by a corresponding motor system 166 (for example comprising a respective electric motor driven by a respective motor driving unit comprising a respective inverter and a TRIAC) controlled by the control unit 105.

In this way, the circulation pump 130 and the drain pump 160 may be controlled to operate concurrently and independently.

However, the concepts of the present invention can be applied to cases in which a single motor system is provided, configured to selectively drive the circulation pump 130 or the drain pump 160. In this latter case, the circulation pump 130 and the drain pump 160 cannot be controlled to operate concurrently. For example, the electric motors of the circulation pump 130 and of the drain pump 160 may be driven by a same inverter. In this case, a single motor system may be provided comprising the electric motors of the two pumps, the respective TRIACs, and a single inverter. Said single inverter may be selectively coupled (e.g., by means of respective switches) to the TRIAC controlling the motor of the circulation pump 130 or to the TRIAC controlling the motor of the drain pump 160. According to an embodiment of the present invention, the dishwasher 100 further comprises at least one pump sensor unit 190 configured to measure an electromechanical parameter of the circulation pump 130, such as an electric current drawn by the circulation pump 130, a voltage across the circulation pump 130, the power consumption of the circulation pump 130 and/or a torque of the circulation pump 130, and provide said measure to the control unit 105.

According to an embodiment of the present invention, the dishwasher 100 further comprises a water softening system 195 (for example connected between the water inlet 122 and the inlet valve 120) configured to reduce hardness of water fed to the appliance through the water inlet 122 and used for generating the washing fluid. Without having to introduce details well known to those skilled in the art, the water softening system 195 comprises a container containing a water softening agent (e.g., a ion-exchange resin) capable of reducing hardness of water by promoting exchange of the minerals dissolved in water causing hardness (e.g., calcium and magnesium) for a soft mineral that does not build up on surfaces, such as sodium. After several uses, the water softening agent gets exhausted, which strongly reduces water softening performance. For this reason, the water softening system 195 comprises a (refillable) container for storing a regenerating agent, usually salt (e.g., Sodium chloride salt), to be used for regenerating the exhausted softening agent during a water softening agent regeneration procedure.

According to an embodiment of the present invention, the control unit 105 is configured to manage the operation of the dishwasher 100 by carrying out proper software/firmware routines installed/stored in one or more memory units comprised in or associated to the control unit 105.

Figure 2:
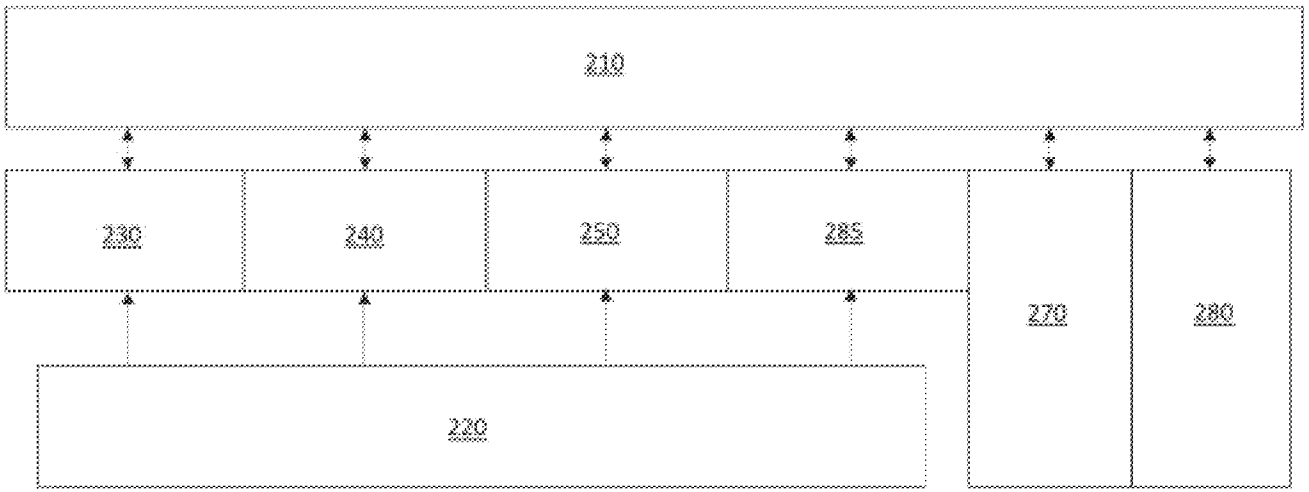

FIG. 2 illustrates in terms of functional blocks some of the routines that can be carried out by the control unit 105 for controlling the operations of the dishwasher according to an embodiment of the present invention.

As will be described in details in the following, at least some of the routines may be carried out by the control unit 105 concurrently with and/or in alternative to other routines. Moreover, at least some of the routines may interact with other routines, with the operation of a routine that may influence the operation of one or more other different routines.

As will be described in the following of the description, at least some of the routines are advantageously configured to allow the control unit 105 to efficiently control the operation of the dishwasher 100 without the need that the dishwasher 100 is equipped with a pressure sensor for the determination of the level of washing fluid inside the tub 110. In this way, a correct and reliable operation of the dishwasher 100 can be guaranteed even if the dishwasher is lacking of a pressure sensor for the determination of the level of washing fluid inside the tub 110.

According to an embodiment of the present invention, a routine that can be carried out by the control unit 105, hereinafter also referred to as "washing cycle routine" and identified in FIG. 2 with reference 210, provide for controlling the hydraulic, electronic, electric and electromechanical components of the dishwasher 100 for performing user-selected washing cycles. For example, based on a phase of the washing cycle currently being performed by the dishwasher 100, the washing cycle routine 310 may provide for controlling the discharge of detergent into the tub 110, set a target speed S for the recirculation pump 130, selects the activation of one or more spray device(s) 132, 134, 136, set the temperature of the washing fluid, and so on.

According to an embodiment of the present invention, another routine that can be carried out by the control unit 105, hereinafter also referred to as "circulation pump operative state routine" and identified in FIG. 2 with reference 220 provides for allowing the control unit 105 to determine an operative state of the circulation pump 130 between.

- a so-called "saturation state" indicative that sufficient washing fluid is present in the tub 110 to prevent air from being drawn out by the circulation pump 130 during its operation, and
- a so-called "starvation state" indicative that insufficient washing fluid is present in the tub 110 to prevent air from being drawn out by the circulation pump 130 during its operation.

In other words, a saturation state is determined when the amount of washing fluid in the tub is sufficient or high enough to prevent air from being drawn out by the circulation pump 130, and a starvation state is determined when the amount of washing fluid in the tub is insufficient or not sufficient or not high enough to prevent air from being drawn out by the circulation pump 130.

Without entering into excessive details, according to an embodiment of the present invention, through the circulation pump operative state routine 220, the control unit 105 is configured to determine the operative state of the circulation pump 130 between the saturation state and the starvation state based on at least one electromechanical parameter of the circulation pump 130 sensed by the pump sensor unit 190, such as for example at least one among:

- an electric current drawn by the circulation pump 130 during its operation;
- a voltage developed across the circulation pump 130 during its operation,
- a power consumption of the circulation pump 130 during its operation;
- a torque of the circulation pump 130 during its operation.

Indeed, the behavior of these electromechanical parameters of the circulation pump 130 is influenced by the operative state (saturation or starvation) of the circulation pump 130. Having the circulation pump that is operating at a certain speed SC, a starvation state is determined when the current value of the electric current drawn by the circulation pump 130 is subjected to a drop. Similar considerations apply by considering other electromechanical parameters of the circulation pump 130, such as the voltage, the power or the torque.

Figure 3B:
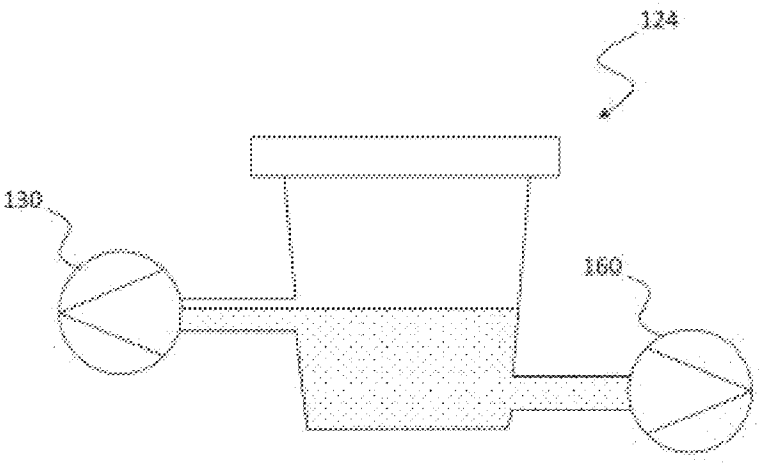
FIG. 3B shows an exemplary condition of a sump of the dishwasher of FIG. 1 in which a circulation pump of the dishwasher is in a starvation state.
Figure 3A:
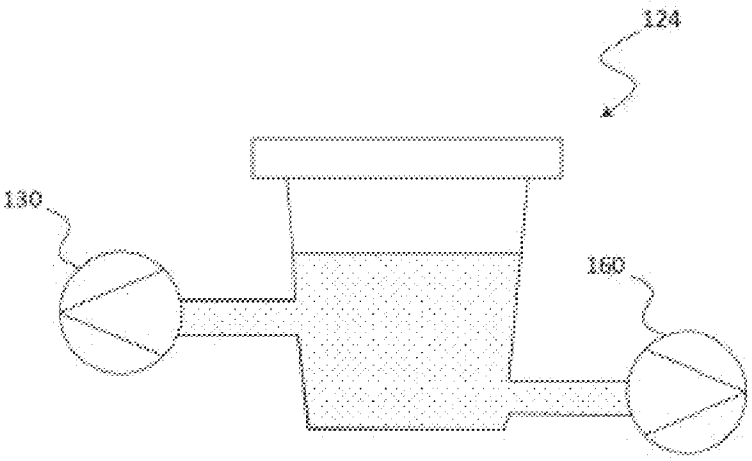
FIG. 3A shows an exemplary condition of a sump of the dishwasher of FIG. 1 in which a circulation pump of the dishwasher is in a saturation state.

In the exemplary case illustrated in FIG. 3A, the circulation pump 130 is in the saturation state, with an amount of washing fluid in the sump 124 that is sufficient to prevent air from being drawn out by the circulation pump 130. In the exemplary case illustrated in FIG. 3B, the circulation pump 130 is in the starvation state, since it is sucking air during its operation because of an insufficient amount of washing fluid in the sump 124.

Returning back to FIG. 2B, according to an embodiment of the present invention, another routine that can be carried out by the control unit 105, hereinafter also referred to as "controlled circulation routine" and identified in FIG. 2 with reference 230, provides for efficiently controlling the current speed SC of the circulation pump 130 based on an indication of a target speed 7N for the recirculation pump 130. The controlled circulation routine 230 will be described in greater detail in the following of the description.

According to an embodiment of the present invention, a further routine that can be carried out by the control unit 105, hereinafter also referred to as "fill to speed routine" and identified in FIG. 2 with reference 240, provides for controlling the inlet valve 120 to load in the tub 110 amounts of washing fluid dosed in such a way to allow a correct operation of the dishwasher 100 when the latter is operating with the circulation pump 130 at a circulation pump speed SC based on said target speed TS. The fill to speed routine 240 will be described in greater detail in the following of the description.

According to an embodiment of the present invention, another routine that can be carried out by the control unit 105, hereinafter also referred to as "drain to speed routine"

and identified in FIG. 2 with reference 250, provides for controlling the drain pump 160 to drain out from the tub 110 (and from the dishwasher 100) amounts of washing fluid dosed in such a way to allow a correct operation of the dishwasher 100 when the latter is operating with the circulation pump 130 at a circulation pump speed SC based on said target speed TS. The drain to speed routine 250 will be described in greater detail in the following of the description.

According to an embodiment of the present invention, a further routine that can be carried out by the control unit 105, hereinafter also referred to as "drain to empty procedure" and identified in FIG. 2 with reference 270, provides for controlling the drain pump 160 to drain out washing fluid so as to empty the tub 110 (and the sump 124). The drain to empty procedure 270 will be described in greater detail in the following of the description.

According to an embodiment of the present invention, another routine that can be carried out by the control unit 105, hereinafter also referred to as "fill to speed not empty", and identified in FIG. 2 with reference 280, provides for controlling the inlet valve 120 to cause a correct filling of washing fluid in the tub 110 starting from a condition in which the sump 124 is assumed to be empty.

According to an embodiment of the present invention, another routine that can be carried out by the control unit 105, hereinafter also referred to as "inlet valve checking procedure" and identified in FIG. 2 with reference 285, provides for verifying the correct operation of the inlet valve 120, and particularly to determine if the inlet valve 120 is subjected to a fault causing undesired leakages when in the closed condition. The inlet valve checking procedure 285 will be described in greater detail in the following of the description.

As graphically illustrated in FIG. 2, the routines 230, 240, 250 and 285 are configured to operate by taking into account the output produced by the routine 220, i.e., by taking into account the operative state of the circulation pump 130 (saturation state or starvation state).

In the following sections of the description, some of the routines that can be carried out by the control unit 105 according to embodiment of the present invention will be described in greater detail.

Controlled Circulation Routine 230

In general, according to an embodiment of the present invention, the controlled circulation routine 230 provides for causing the speed SC of the circulation pump 130 to increase towards the target speed TS with a first speed increase rate R1. If a starvation state of the circulation pump 130 is determined, and at the same time the inlet valve 120 is in the open condition (causing thus washing fluid being loaded into the tub 110) before the the speed SC of the circulation pump 130 reached the target speed TS, the speed SC of the circulation pump 130 is set to increase towards the target speed TS with a second speed increase rate R2 lower than the first speed increase rate R1.

Figure 4A:
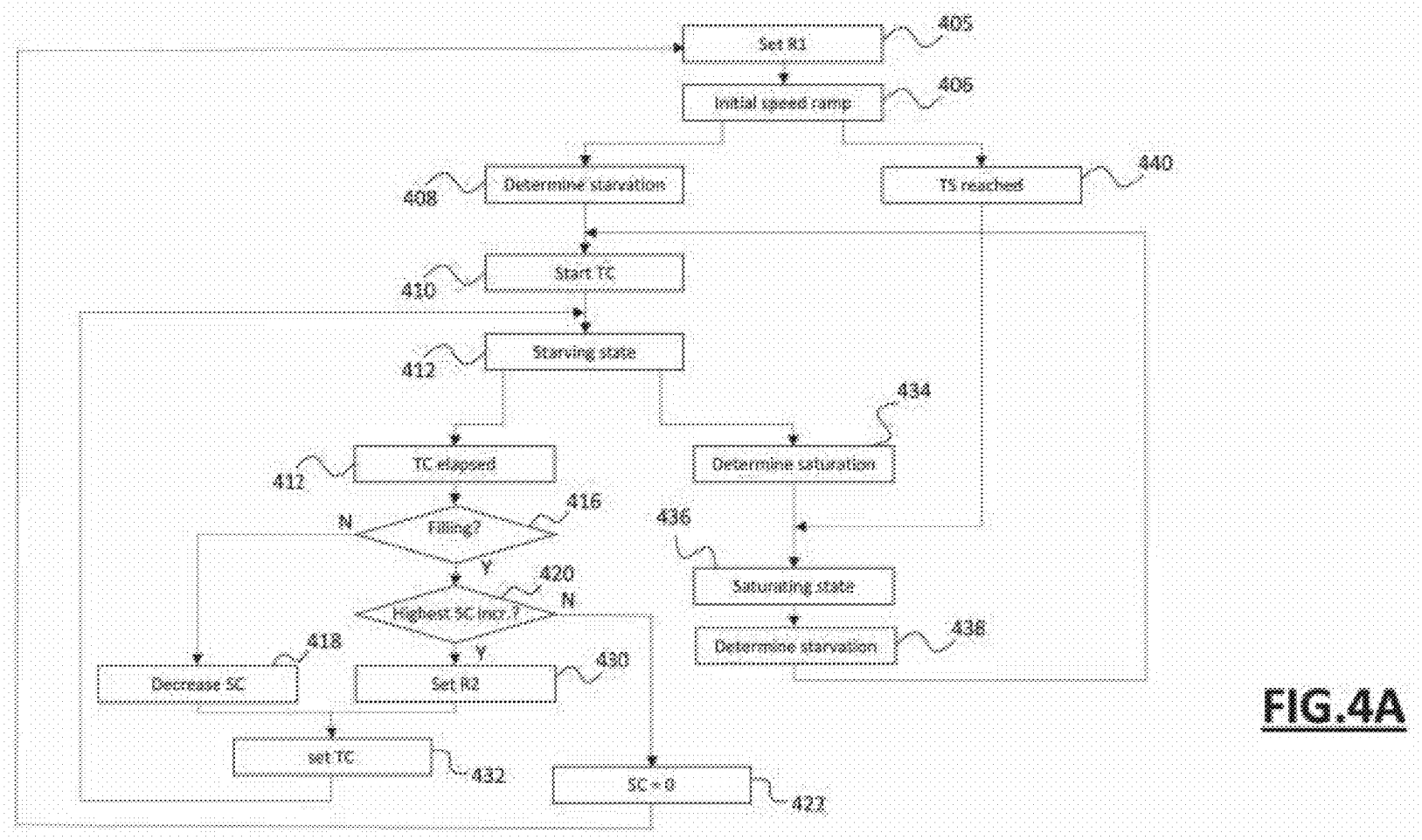
FIG. 4A illustrates in terms of functional blocks a flow chart depicting the operations carried out by the control unit of the dishwasher of FIG. 1 when a controlled circulation routine is being carried out according to an embodiment of the present invention.

FIG. 4A illustrates in terms of functional blocks a flow chart depicting the operations carried out by the control unit 105 when the controlled circulation routine 230 is being carried out according to an embodiment of the present invention.

According to an embodiment of the present invention, the control unit 105 sets a first increase rate R1 for the speed SC of the circulation pump 130 (block 405).

Then, according to an embodiment of the present invention, the controlled circulation routine 230 enters in a so-called "initial speed ramp state" in which the control unit 105 causes the speed SC of the circulation pump 130 to increase—from a starting value, e.g., equal to zero if the circulation pump 130 is stopped—towards the target speed TS with said first increase rate R1 (block 406). According to an embodiment of the present invention, the value of the target speed TS is set by the washing cycle procedure 210, depending on a user-selected washing cycle (and/or based on a phase thereof) being currently carried out by the dishwasher 100.

According to an embodiment of the present invention, said first increase rate R1 is higher than 70 RPM/s, such as for example equal to 80 RPM/s.

According to an embodiment of the present invention, if a starvation state of the circulation pump 130 is determined (by the circulation pump operative state routine 220) before the speed SC of the circulation pump 130 reached the target speed TS (block 408), the control unit 105 initializes a timer TC (block 410) and starts the timer TC to count a predetermined time period (e.g., 200 ms). Then, the controlled circulation routine 230 enters in a so-called "starving state" (block 412), in which the speed SC of the circulation pump 130 is caused to increase by the control unit 105 with the actually set increase rate while the circulation pump 130 is determined to be in the starvation state.

According to an embodiment of the present invention, if the timer TC elapses without having a saturation state of the circulation pump 130 be determined by the circulation pump operative state routine 220 (block 414), the control unit 105 checks if the inlet valve 120 is in the open condition or in the closed position (block 416). According to an embodiment of the present invention, the condition (open or closed) of the inlet valve 120 is set by the fill to speed routine 240.

According to an embodiment of the present invention, if the inlet valve 120 is in the closed position (exit branch N of block 416), meaning that no new washing fluid is being fed into the tub 110 from outside the dishwasher 100, the control unit 105 causes the increasing rate of the speed SC of the circulation pump 130 to be set to zero, and causes the speed SC of the circulation pump 130 to be decreased by a corresponding decreasing amount DSC (block 418).

According to an embodiment of the present invention, if the inlet valve 120 is in the open condition (exit branch Y of block 416), meaning that new washing fluid is being fed into the tub 110 from outside the dishwasher 100, the control unit 105 checks (block 420) if the highest value reached by the speed SC of the circulation pump 130 has been subjected to any increase for a corresponding time period (e.g., 45 s). In case the highest value reached by the speed SC of the circulation pump 130 did not increase during said time period (exit branch N of block 420), the control unit 105 stops (block 422) the circulation pump 130 for a time interval, such as for 5 s, for removing air from the circulation pump 130, and then the operations flow returns to block 405. In case the highest value reached by the speed SC of the circulation pump 130 did increase at least once during said time period (exit branch Y of block 420), the control unit 105 causes the speed SC of the circulation pump 130 to increase towards the target speed TS with a second increase rate R2 lower than the first increase rate R1 (block 430). According to an embodiment of the present invention, said decreasing amount DSC is equal to 100 RPM/s. According to an embodiment of the present invention, said second increase rate R2 is lower than 10 RPM/s, such as for example equal to 5 RPM/s.

Then, the control unit 105 reinitializes the timer TC and starts the timer TC to count a further time period (block 432), for example 4s.

At this point, the operations flow returns to block 412, where the previously described operations are reiterated, with the reinitialised timer TC and the new value of the speed SC and/or the new value for the increase rate of the speed SC.

According to an embodiment of the present invention, if a saturation state of the circulation pump 130 is determined by the circulation pump operative state routine 220 before the timer TC elapses (block 434), after a further time period is expired (e.g., 2 s), the controlled circulation routine 230 enters in a so-called "saturating state" (block 436), in which the speed SC of the circulation pump 130 is caused to increase by the control unit 105 with a third increase rate R3 lower than the first increase rate R1 and higher than the second increase rate R2 while the circulation pump 130 is determined to be in the saturation state. According to an embodiment of the present invention, the value of the third increase rate R3 depends on the condition (open/closed) of the inlet valve 120. According to an embodiment of the present invention, if the inlet valve is in the open condition, the third increase rate R3 is higher than 50 RPM/s, for example equal to 60 RPM/s, while if the inlet valve is in the closed condition, the third increase rate R3 is lower than 50 RPM/s, for example equal to 40 RPM/s.

Then, according to an embodiment of the present invention, when a starvation state of the circulation pump 130 is determined again by the circulation pump operative state routine 220 (block 438), the operations flow returns to block 410, wherein the control unit 105 reinitializes the timer 71C and the controlled circulation routine 230 enters again in the starving state (block 412).

Returning back to block 406, according to an embodiment of the invention, if the speed SC of the circulation pump 130 reaches the target speed TS before a starvation state of the circulation pump 130 is determined by the circulation pump operative state routine 220 (block 440), the operations flow goes to clock 436, where the controlled circulation routine 230 enters in the saturating state.

When carrying out the controlled circulation routine 230 according to the embodiments of the invention illustrated in FIG. 4A, the control unit 105 tries to cause the circulation pump 130 to operate at the target speed TS by increasing the speed SC of the circulation pump 130 starting from a starting value with a corresponding speed increase rate (blocks 405, 406). The target speed TS can be reached without causing the circulation pump 130 to enter in the starvation state (block 440). If the target speed TS cannot be reached without causing a starvation state of the circulation pump 130 (block 408), the control unit 105 controls the speed SC to reach the highest speed SC capable of maintaining the circulation pump 130 in the saturation state. This is done by slowly increasing the speed SC until a starvation state of the circulation pump 130 is detected, and then:

- if the inlet valve 120 is closed, by lowering the speed SC until a saturation state of the circulation pump 130 is restored,
- if the inlet valve 120 is open, by increasing the speed SC at a lower speed increase rate until a saturation state of the circulation pump 130 is restored.

Figure 4B:
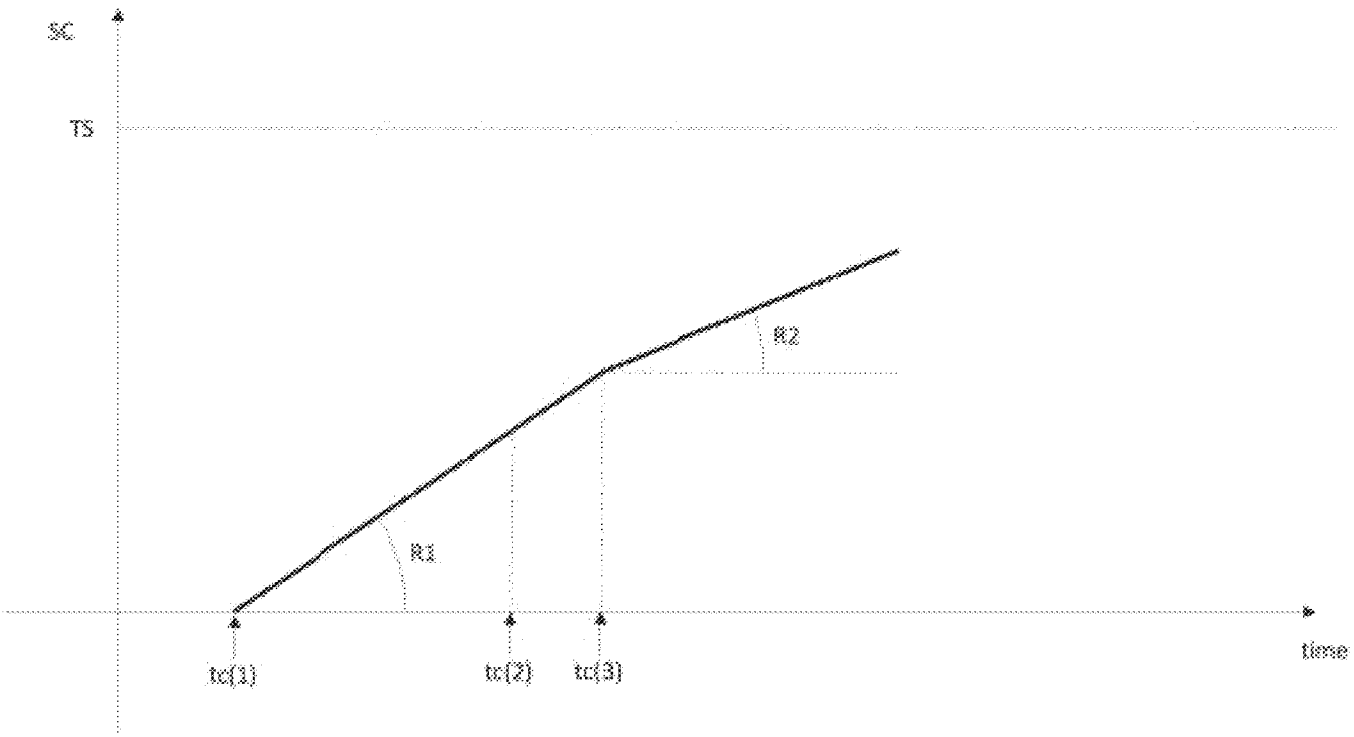
FIG. 4B is an exemplary time diagram showing how a speed of the circulation pump of the dishwasher of FIG. 1 varies over time under the control of the control unit when the latter is carrying out the controlled circulation routine of FIG. 4A according to an embodiment of the present invention.

FIG. 4B is an exemplary time diagram showing how the speed SC of the circulation pump 130 varies over time under the control of the control unit 105 when the latter is carrying out the controlled circulation routine 230 according to an embodiment of the present invention.

In the example illustrated in FIG. 4B, the circulation pump 130 is initially turned off, and therefore the speed SC is equal to zero. At time tc(1), the controlled circulation routine 230 is started, and the control unit 105 causes the circulation pump 130 to increase the speed SC of the circulation pump 130 with a corresponding first speed increase rate R1 (blocks 405, 406). At time tc(2), a starvation state of the circulation pump 130 is determined, before the speed SC of the circulation pump 130 reached the target speed TS (block 408). At this point, the control unit 105 initializes and starts the timer TC to count a predetermined time period (block 410). In the example considered, the timer 71C expires at time tc(3) before a saturation state of the circulation pump 130 is determined (block 414). In the example considered, at time tc(3) the inlet valve 120 is in the open condition (exit branch Y of block 416), and therefore the control unit 105 verifies if the highest value reached by the speed SC of the circulation pump 130 has been subjected to any increase during a past time period from time tc(3) (block 420). Since in the considered example the speed SC of the circulation pump 130 was constantly increasing from time tc(1) to time tc(3), this condition is verified (exit branch Y of block 420), and therefore the control unit 105 varies the increase rate of the speed SC of the circulation pump 130 to a second speed increase rate R2 lower than the first speed increase rate R1 (block 430).

Thanks to the controlled circulation routine 230 according to the embodiments of the invention it is therefore possible to efficiently control the current speed SC of the circulation pump 130 to reach a value corresponding to a requested target speed T without requiring the presence of a pressure sensor for the determination of the level of washing fluid currently inside the tub 110.

Fill to Speed Routine 240

In general, according to an embodiment of the present invention, the fill to speed routine 240 provides for causing the inlet valve 120 to be opened in order to fill washing fluid in the tub 110 when the speed SC of the circulation pump 130 is lower than or equal to the target speed TS if a starvation state of the circulation pump 130 is determined. The fill to speed routine 240 also provides for causing the inlet valve 120 to be closed if a saturation state of the circulation pump 130 is determined. According to an embodiment of the present invention, in order to reduce the number of times the inlet valve 120 switches between the open and closed conditions, the closure of the valve is delayed in case the speed SC of the circulation pump 130 is lower than the target speed TS by a sufficiently large amount.

Figure 5:
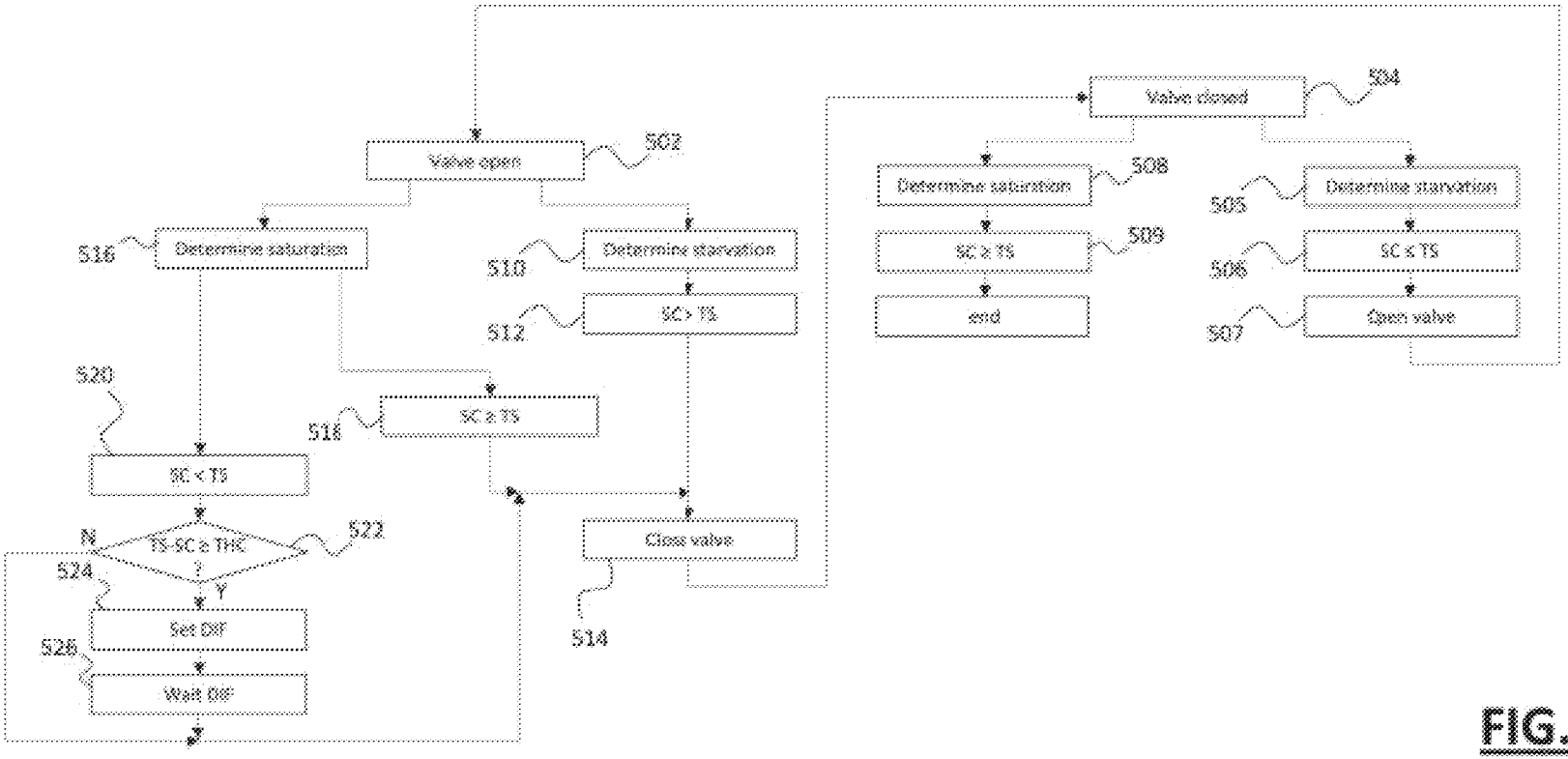
FIG. 5 illustrates in terms of functional blocks a flow chart depicting the operations carried out by the control unit of the dishwasher of FIG. 1 when a fill to speed routine is being carried out according to an embodiment of the present invention.

FIG. 5 illustrates in terms of functional blocks a flow chart depicting the operations carried out by the control unit 105 when the fill to speed routine 240 is being carried out according to an embodiment of the present invention.

According to an embodiment of the present invention, the fill to speed routine 240 may switch between two different states, and namely a so-called "valve open state" (block 502) corresponding to an open condition of the inlet valve 120 for causing new washing fluid to be fed to the dishwasher 100 for being loaded in the tub 110 and a so-called "valve closed state" (block 504) corresponding to a closed condition of the inlet valve 120 for preventing new washing fluid to be fed to the dishwasher 100.

The initial state of the fill to speed routine 240 depends on the current state of the inlet valve 120.

Starting from the valve closed state (block 504), in which the inlet valve 120 is in the closed condition, according to an embodiment of the invention, if a starvation state of the circulation pump 130 is determined (block 505), when the speed SC of the circulation pump 130 is equal to or lower than the target speed TS (block 506), the control unit 105 causes the inlet valve 120 to switch to the open condition for causing new washing fluid to be fed in the tub 110 (block 507). Then, the fill to speed routine 240 switches to the valve open state (going to block 502).

According to an embodiment of the invention, if instead a saturation state of the circulation pump 130 is determined (block 508), when the speed SC of the circulation pump 130 is equal to or higher than the target speed TS (block 509), the fill to speed routine 240 terminates.

According to an embodiment of the present invention, when the fill to speed routine 240 is in the valve open state (block 502), and a starvation state of the circulation pump 130 is determined (block 510), when the speed SC of the circulation pump 130 is higher than the target speed TS (block 512), the control unit 105 causes the inlet valve 120 to switch to the closed condition for preventing new washing fluid be fed to the dishwasher 100 (block 514). Then the fill to speed routine 240 switches the valve closed state (going to block 504).

According to an embodiment of the present invention, when the fill to speed routine 240 is in the valve open state (block 502), and a saturation state of the circulation pump 130 is determined (block 516), when the speed SC of the circulation pump 130 is equal to or higher than the target speed TS (block 518), the control unit 105 causes the inlet valve 120 to switch to the closed condition for preventing new washing fluid be fed to the dishwasher 100 (block 514). Then, the fill to speed routine 240 switches to the valve closed state (going to block 504).

According to an embodiment of the present invention, when the fill to speed routine 240 is in the valve open state (block 502), and a saturation state of the circulation pump 130 is determined (block 516), when the speed SC of the circulation pump 130 is lower than the target speed TS (block 520), the control unit 105 checks (block 522) if the speed SC is however close to (e.g., only slightly lower than) the target speed TS, or if said speed SC is still far from (e.g., substantially lower than) the target speed TS.

According to an embodiment of the present invention, if the difference between the target speed TS and the speed SC of the circulation pump 130 is not higher than a speed threshold THC (exit branch N of block 522), the control unit 105 directly causes the inlet valve 120 to switch to the closed condition for preventing new washing fluid be fed to the dishwasher 100 (block 514). Then, the fill to speed routine 240 switches to the valve closed state (going to block 504).

According to an embodiment of the present invention, if the difference between the target speed TS and the speed SC of the circulation pump 130 is higher than a speed threshold THC (exit branch Y of block 522), the control unit 105 causes a delayed switching of the inlet valve 120 to the closed condition. According to an embodiment of the invention, the control unit 105 causes the inlet valve 120 to switch to the closed position only after a delay interval DIF is expired.

According to an embodiment of the present invention, said speed threshold THC is higher than 100 RPM and lower than 300 RPM, for example is equal to 200 RPM.

According to an embodiment of the present invention, the duration of the delay interval DIF depends on the difference ΔF between the target speed TS and the speed SC of the circulation pump 130.

According to an embodiment of the present invention, the control unit 105 set the delay interval DIF (block 524) to a value that is proportional to the difference ΔF between the target speed IS and the speed SC of the circulation pump 130. According to an embodiment of the present invention, the delay interval DIF is set to a maximum predetermined value MDIF if the difference ΔF is excessively large. For example, according to an embodiment of the present invention, the control unit 105 sets the delay interval DIF to the minimum value between.

ΔF*PF, and

MDIF, wherein PF is a proportionality parameter.

For example, MDIF may be set to 10000 ms and PF may be set to 20 ms.

According to an embodiment of the present invention, when the delay interval DIF is expired (block 526), the control unit 105 causes the inlet valve 120 to switch to the closed condition for preventing new washing fluid be fed to the dishwasher 100 (block 514). Then, the fill to speed routine 240 switches to the valve closed state (going to block 504).

By delaying the closure of the inlet valve 120 when the speed SC is still far from (e.g., substantially lower than) the target speed TS, an additional amount of washing fluid is fed into the tub 110, advantageously reducing the possibility that, once the inlet valve 120 is in the closed condition, the circulation pump 130 enters into the starvation state (with a consequent reopening of the inlet valve 120). In this way, undesired "bouncing" between the open and closed condition of the inlet valve 120 is advantageously reduced.

Thanks to the fill to speed routine 240 according to the embodiments of the invention, it is possible to efficiently control the inlet valve 120 to load in the tub 110 amounts of washing fluid dosed in such a way to allow a correct operation of the dishwasher 100 when the latter is operating with the circulation pump 130 at a circulation pump speed SC based on said target speed TS, without requiring the presence of a pressure sensor for the determination of the current level of washing fluid inside the tub 110.

According to an embodiment of the present invention, the controlled circulation routine 230 and the fill to speed routine 240 are two routines that can be expediently carried out by the control unit 105 concurrently, since each one of the two routines requires, among its inputs, something that can be output by the other routine.

Particularly, in order to be correctly executed, the controlled circulation routine 230 requires to receive the indication of the target speed TS, an indication of the operative state PC (starvation state or saturation state) of the circulation pump 130, and an indication of the condition VC (open condition or closed condition) of the inlet valve 120. Moreover, in order to be correctly execute, the fill to speed routine 240 requires to receive the indication of the target speed TS, the indication of the operative state PC of the circulation pump 130, and an indication of the current speed SC of the circulation pump 130.

Figure 6:
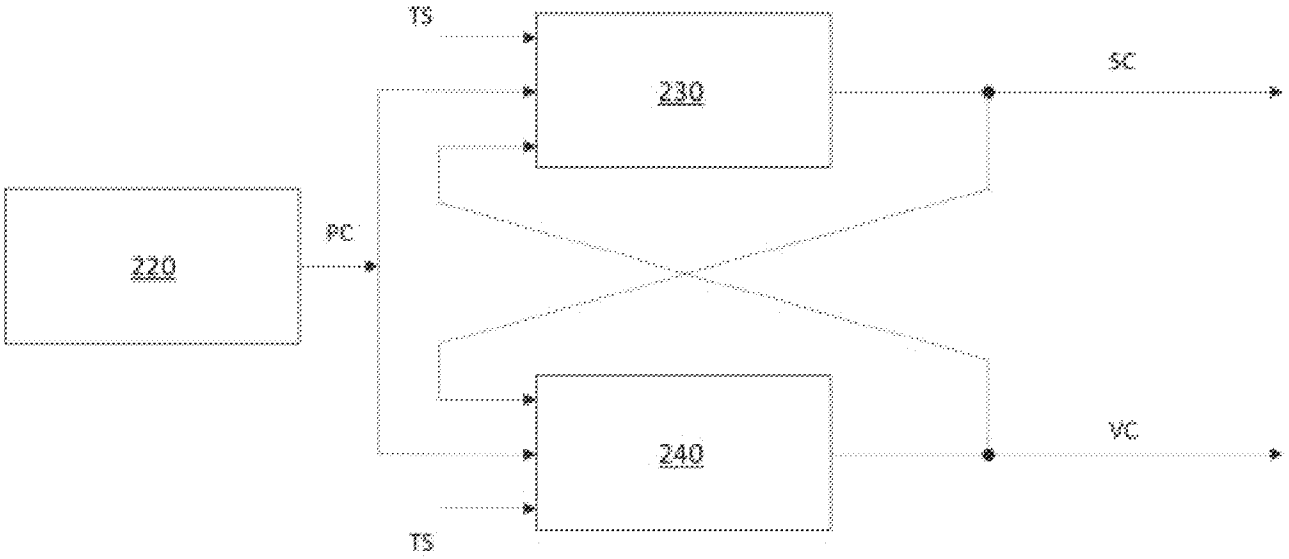
FIG. 6 is a schematic functional block showing an interaction between the controlled circulation routine of FIG. 4A and the fill to speed routine of FIG. 5 according to an embodiment of the present invention.

By making reference to the schematic functional block of FIG. 6, since the speed SC of the circulation pump 130 is set by the controlled circulation routine 230 (based on TS, PC, VC), and the condition VC of the inlet valve is set by the fill to speed routine 240 (based on TS, PC, SC), according to an embodiment of the present invention, the controlled circulation routine 230 and the fill to speed routine 240 may be advantageously executed concurrently, using the indication of the condition VC of the inlet valve 120 set by the fill to speed routine 240 as an input for the controlled circulation routine 230, and using the indication of the speed SC of the circulation pump 130 set by the controlled circulation routine 230 as an input for the fill to speed routine 240.

According to an embodiment of the present invention, when the controlled circulation routine 230 and the fill to speed routine 240 are concurrently executed, each one of said routines may operate by using a respective different target speed TS.

According to an embodiment of the present invention, the control unit 105 may control the speed SC of the circulation pump 130 (by running the controlled circulation routine 230) based on:

a first target speed TS1;

the indication of the condition VC of the inlet valve 120;

the indication of the operative state PC of the circulation pump 130.

According to an embodiment of the present invention, the control unit 105 may control the condition VC of the inlet valve 120 (by running the fill to speed routine 240) based on:

a second target speed 752;

the indication of the speed SC of the circulation pump 130;

the indication of the operative state PC of the circulation pump 130.

For example, if the first target speed TS1 is set to a value higher than the value of the second target speed TS2 (e.g., TS1 is set to 2000 RPM, and TS2 is set to 1800 RPM), as long as the current speed SC of the circulation pump 130 is equal to or lower than TS2, both the two routines are carried out by the control unit 105. When the speed SC of the circulation pump 130 is higher than TS2, the fill to speed routine 240 is prevented to cause the opening of the inlet valve 120.

Drain to Speed Routine 250

In general, according to an embodiment of the present invention, the drain to speed routine 250 provides for performing partial drains of washing fluid by causing the drain pump 160 to be activated to drain amounts of washing fluid out from the tub 110 (and from the dishwasher 100) when the speed SC of the circulation pump 130 is higher than or equal to the target speed TS if a saturation state of the circulation pump 130 is determined.

Figure 7:
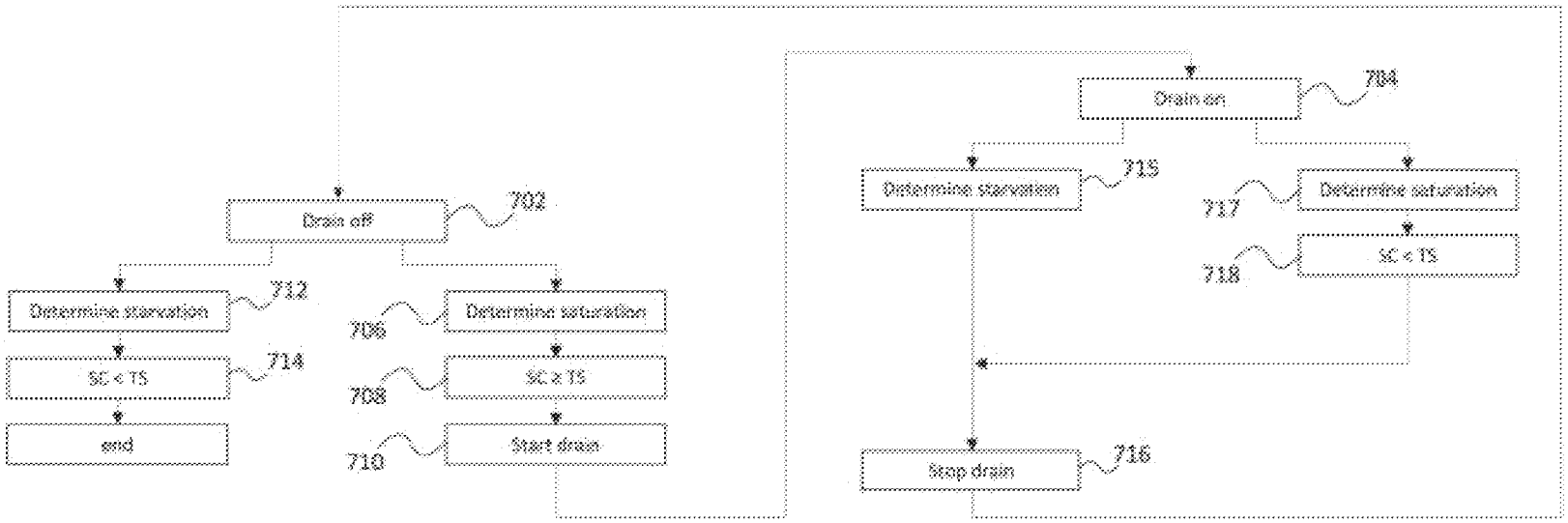
FIG. 7 illustrates in terms of functional blocks a flow chart depicting the operations carried out by the control unit of the dishwasher of FIG. 1 when a drain to speed routine is being carried out according to an embodiment of the present invention.

FIG. 7 illustrates in terms of functional blocks a flow chart depicting the operations carried out by the control unit 105 when the drain to speed routine 350 is being carried out according to an embodiment of the present invention.

According to an embodiment of the present invention, the drain to speed routine 250 may switch between two different states, and namely a so-called "drain off state" (block 702) corresponding to a deactivated condition of the drain pump 160 for preventing washing fluid in the tub 110 to be drained out from the dishwasher 100, and a so-called "drain on state" (block 704) corresponding to an activated condition of the drain pump 160 for causing washing fluid to be drained out from the tub 110.

Starting from the drain off state (block 702), in which the drain pump 160 is in the deactivated condition, according to an embodiment of the present invention, if a saturation state of the circulation pump 130 is determined (block 706), when the speed SC of the circulation pump 130 is equal to or higher than the target speed TS (block 708), the control unit 105 causes the drain pump 160 to switch to the activated condition (block 710) for causing washing fluid to be drained out from the tub 110. Then, the drain to speed routine 250 switches to the drain on state (going to block 704).

According to an embodiment of the present invention, when the drain to speed routine 250 is in the drain off state (block 702), with the drain pump 160 that is in the deactivated condition, if a starvation state of the circulation pump 130 is determined (block 712), when the speed SC of the circulation pump 130 is lower than the target speed T (block 714), the drain to speed routine 250 terminates.

According to an embodiment of the present invention, when the drain to speed routine 250 is in the drain on state (block 704), with the drain pump 160 that is in the activated condition, if a starvation state of the circulation pump 130 is determined (block 715), the control unit 105 causes the drain pump 160 to switch to the deactivated condition (block 716) for preventing washing fluid to be drained out from the tub 110. Then, the drain to speed routine 250 switches to the drain off state (going to block 702).

According to an embodiment of the present invention, when the drain to speed routine 250 is in the drain on state (block 704), with the drain pump 160 that is in the activated condition, if a saturation state of the circulation pump 130 is determined (block 717), when the speed SC of the circulation pump 130 is lower than the target speed TS (block 718), the control unit 105 causes the drain pump 160 to switch to the deactivated condition (block 716) for preventing washing fluid to be drained out from the tub 110. Then, the drain to speed routine 250 switches to the drain off state (going to block 702).

Thanks to the drain to speed routine 250 according to the embodiments of the invention it is therefore possible to carry out partial drains of washing fluid by efficiently control the drain of amounts of washing fluid from the tub 110 (and from the dishwasher 100) dosed in such a way to allow a correct operation of the dishwasher 100 when the latter is operating with the circulation pump 130 at a circulation pump speed SC based on said target speed TS, without requiring the presence of a pressure sensor for the determination of the current level of washing fluid inside the tub 110.

It is pointed out that since the drain to speed routine 250 according to the embodiments of the invention illustrated above requires that the circulation pump 130 and the drain pump 160 are driven concurrently, said routine can be implemented only in case the the circulation pump 130 and the drain pump 160 are driven by respective different and independent motor systems (i.e., the motor systems 165 and 166).

Drain to Empty Routine 270

In general, according to an embodiment of the present invention, the drain to empty routine 270 provides for activating the drain pump 160 for draining washing fluid from the tub 110 (and from the sump 124) until an empty condition of the sump 124 is detected in which the sump 124 substantially does not contain washing fluid. The empty condition of the sump 124 is detected by controlling the circulation pump 130 to rotate in a second, backward, direction (opposite to the first, forward direction normally employed for circulating the washing fluid in the tub 110, so that no circulation of washing fluid in the tub 110 occurs), collecting samples of an electromechanical parameter of the circulation pump 130 sensed by the pump sensor unit 190 during the rotation in the backward direction, and then by comparing said collected samples with a threshold ETH.

According to an embodiment of the present invention, said electromechanical parameter of the circulation pump 130 is an electric current drawn by the circulation pump 130, a voltage across the circulation pump 130, the power consumption of the circulation pump 130 and/or a torque of the circulation pump 130.

According to an embodiment of the present invention, the control unit 105 is configured to calculate an energy value EV indicative of an electric energy consumed by the circulation pump 130 during the rotation in the backward direction based on the collected samples, and then by comparing said calculated energy value EV with the threshold ETH. If the energy value EV is higher than the threshold ETH, it means that there is still an amount of washing fluid in the tub 110 such to cause the circulation pump 130 to consume a non negligible amount of energy in order to be able to rotate.

Figure 8:
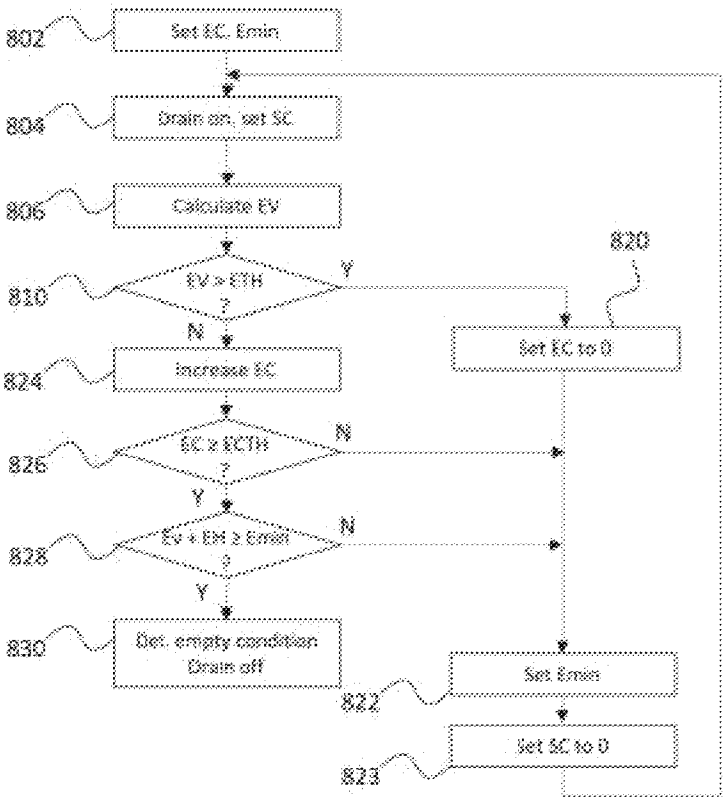
FIG. 8 illustrates in terms of functional blocks a flow chart depicting the operations carried out by the control unit of the dishwasher of FIG. 1 when a drain to empty routine is being carried out according to an embodiment of the present invention.

FIG. 8 illustrates in terms of functional blocks a flow chart depicting the operations carried out by the control unit 105 when the drain to empty routine 270 is being carried out according to an embodiment of the present invention.

According to an embodiment of the present invention, the control unit 105 sets to zero an energy counter EC indicative of a number of times in a row the energy value EV has been determined to be lower than the threshold ETH, and set a minimum energy threshold Emin to a very large value (block 802).

According to an embodiment of the present invention, the control unit 105 controls the drain pump 160 to switch to the activated condition for causing washing fluid in the sump 124 to be drained from the dishwasher 100, and controls the circulation pump 130 to rotate in the backward direction (block 804).

According to an embodiment of the present invention, the control unit 105 collects a set of samples of an electromechanical parameter of the circulation pump 130 sensed by the pump sensor unit 190, such as the electric current I drawn by the circulation pump 130 (similar considerations apply in case a different electromechanical parameter is used, such as the voltage, the power or the torque of the circulation pump 130) and accordingly calculates a corresponding energy value EV (block 806).

According to an embodiment of the present invention, the control unit 105 calculates the energy value EV by summing the samples of the collected set. However, similar considerations apply in case the energy value EV is calculated using the samples in a different way.

According to an embodiment of the present invention, the control unit 105 compares the calculated energy value EV with the threshold ETH (block 810).

According to an embodiment of the present invention, if the calculated energy value EV is higher than the threshold ETH (exit branch Y of block 810), it means that the washing tub 110, and therefore the sump 124, is still containing an amount of washing fluid such to cause the circulation pump 130 to consume a non negligible amount of energy in order to be able to rotate. In this case, according to an embodiment of the present invention, the control unit 105 reset the energy counter EC to zero (block 820), and set the minimum energy threshold Emin to the minimum between the current value of the minimum energy threshold Emin and the last calculated energy value EV (bock 822). Then, according to an embodiment of the present invention, the control unit 105 causes the recirculation pump 130 to be turned off (block 823), and, after a waiting interval, such as 5 s, to be turned on again for rotating in the backward direction (going back to block 804).

According to an embodiment of the present invention, if the calculated energy value EV is lower than the threshold ETH (exit branch N of block 810), the control unit 105 increases (e.g., by one) the energy counter EC (block 824), and then compares the just increased energy counter EC with an energy counter threshold ECTH (block 826). According to an embodiment of the present invention, the energy counter threshold ECTH is equal to 2. However, similar considerations apply in case the energy counter threshold ECTH has a different value.

According to an embodiment of the present invention, if the energy counter EC is lower than the energy counter threshold ECTH (exit branch N of block 826), the operations flow goes to block 822.

According to an embodiment of the present invention, if the energy counter EC is higher than the energy counter threshold ECTH (exit branch Y of block 826), it means that the energy value EV has been determined to be lower than the threshold ETH for a number of times in a row sufficient to avoid incorrect determinations of empty conditions of the sump 124 due to spurious variations of the speed SC of the circulation pump 130 independent from the actual level of the washing fluid inside the sump 124.

According to an embodiment of the present invention, if the energy counter EC is higher than the energy counter threshold ECTH, the control unit 105 carries out a stability check for determining if the current energy consumption of the circulation pump 130 is on a stable low value or not by comparing the last calculated energy value EV with the minimum energy threshold Emin (block 828).

According to an embodiment of the present invention, if the last calculated energy value EV plus an energy hysteresis value EH is lower than the energy counter threshold ECTH (exit branch N of block 828), it means that the current energy consumption of the circulation pump 130 is at a value that is not sufficiently low and stable to avoid incorrect determinations of empty conditions of the sump 124, and therefore the operations flow goes to block 822.

According to an embodiment of the present invention, if the last calculated energy value EV plus an energy hysteresis value EH is equal to or higher than the energy counter threshold ECTH (exit branch Y of block 828), it means that a sufficient amount of washing fluid has been drained out, and the control unit 105 determines an empty condition of the sump 124, and thus controls the drain pump 160 to switch to the deactivated condition (block 830).

Thanks to the drain to empty routine 270 according to the embodiments of the invention it is therefore possible to efficiently empty the sump 124 (and therefore the tub 110) and turning off the drain pump 160 when the empty condition of the sump 124 is determined, without requiring the presence of a pressure sensor for the determination of the current level of washing fluid inside the tub 110.

It is pointed out that since the drain to empty routine 270 according to the embodiments of the invention illustrated above requires that the circulation pump 130 and the drain pump 160 are driven concurrently, said routine can be implemented only in case the the circulation pump 130 and the drain pump 160 are driven by respective different and independent motor systems (i.e., the motor systems 165 and 166).

Fill to Speed not Empty Routine 280

In general, according to an embodiment of the present invention, the fill to speed not empty routine 280 provides for controlling the circulation pump 130 to rotate in the backward direction. Then, the inlet valve 120 is caused to switch to the open condition for causing washing fluid be fed into the tub 110 (and therefore into the tub 124) while the circulation pump 130 is rotating backward. Presence of washing fluid inside the sump is determined based on a comparison between an electric parameter of the circulation pump 130 during a first time period TP1 (occurring before the opening of the inlet valve 120) and the electric parameter of the circulation pump 130 during a second time period TP2 (occurring after the opening of the inlet valve 120). A filled condition of the sump 124 is determined if inside the sump 124 there is an amount of washing fluid that is sufficient to cause a sufficiently large increase of the electric parameter of the circulation pump 130 from the first time period TP1 to the second time period TP2.

According to an embodiment of the present invention which will be described in detail in the following, said electric parameter of the circulation pump 130 is an electric current I drawn by the circulation pump 130. In this way, a comparison is made between an electric current I drawn by the circulation pump 130 during the first time period TP1 and an electric current I drawn by the circulation pump 130 during the second time period TP2. However, the concepts of the present invention can be applied to cases in which a different electric parameter of the circulation pump 130 is considered, such as a voltage developed across the circulation pump 130 or the power consumption of the circulation pump 130.

Figure 9:
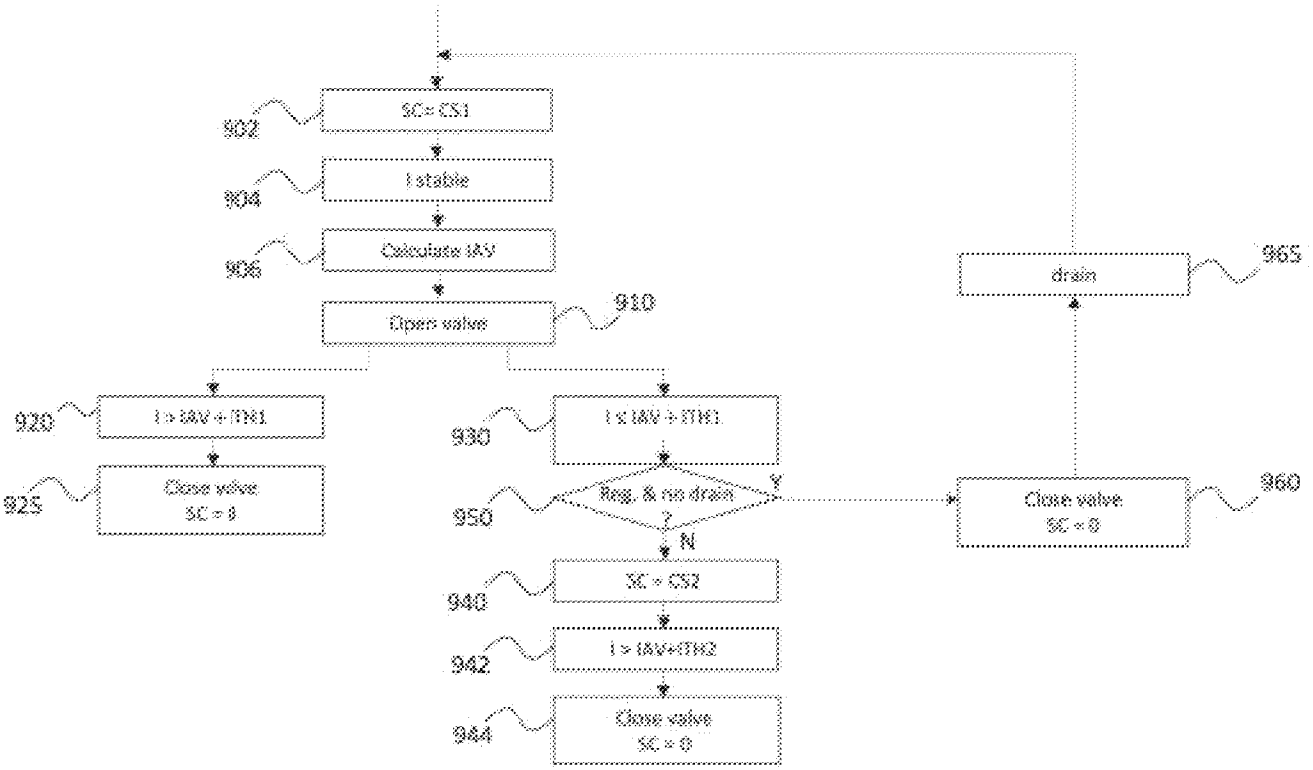
FIG. 9 illustrates in terms of functional blocks a flow chart depicting the operations carried out by the control unit of the dishwasher of FIG. 1 when a fill to speed not empty routine is being carried out according to an embodiment of the present invention.

FIG. 9 illustrates in terms of functional blocks a flow chart depicting the operations carried out by the control unit 105 when the fill to speed not empty routine 280 is being carried out according to an embodiment of the present invention.

According to an embodiment of the present invention, and starting from a condition in which the sump 124 is assumed to be empty, the control unit 105 controls the circulation pump 130 to rotate in the backward direction at a first reverse speed CS1 (block 902). For example, the first reverse speed CS1 may be set to −1000 RPM (the minus sign shows that the circulation pump 130 is rotating in the backward direction, i.e., a direction opposite to the first, forward direction normally employed for circulating the washing fluid in the tub 110, so that no circulation of washing fluid in the tub 110 occurs).

According to an embodiment of the present invention, the control unit 105 waits until the electric current I drawn by the circulation pump 130—sensed by the pump sensor unit 190—reaches a stable value (block 904), for example by observing the fluctuations of said current.

According to an embodiment of the present invention, the control unit 105 calculates an average current value IAV corresponding to the average of the electric current I drawn by the the circulation pump 130 during a first time period TP1 (block 906).

At this point, according to an embodiment of the present invention, the control unit 105 causes the inlet valve 120 to switch to the open condition (block 910), for causing washing fluid to be fed into the tub 110 (and therefore, into the sump 124).

According to an embodiment of the present invention, the control unit 105 is configured to determine the presence of washing fluid inside the sump 124 (filled condition) when the electric current I drawn by the circulation pump 130—sensed by the pump sensor unit 190—during a second time period TP2 after the inlet valve 120 switched to the open condition is higher than the average current value IAV by a first hysteresis threshold ITH1 (block 920). According to an embodiment of the present invention, the hysteresis threshold ITH1 is set to a value higher than 1 mA and lower than 4 mA, such as for example 2 mA.

According to an embodiment of the present invention, the control unit 105 causes the inlet valve 120 to switch to the closed condition, and to cause the circulation pump 130 to stop (block 925).

Thanks to the fill to speed not empty routine 280 according to the embodiments of the invention, it is therefore possible to efficiently assess if washing fluid has been correctly filled in the sump 124 without requiring the presence of a pressure sensor for the determination of the current level of washing fluid inside the tub 110.

The fill to speed not empty routine 280 according to the embodiments of the invention described above is based on the assumption that the sump 124 is initially empty. In order to avoid incorrect results in case the sump 124 was already containing washing fluid at the beginning of the routine, for example because the average current value IAV has a large value, according to an embodiment of the present invention, the fill to speed not empty routine 280 is modified to further provide for the following operations.

Returning back to block 910, where the control unit 105 causes the inlet valve 120 to switch to the open condition, if the electric current I drawn by the circulation pump 130 during the second time period TP2 after the inlet valve 120 switched to the open condition did not become higher than the average current value IA V by the first hysteresis threshold ITH1 (block 930), the control unit 105 causes the circulation pump 130 to rotate in the backward direction at a second reverse speed CS2 having an absolute value higher than an absolute value of said first reverse speed CS (block 940). For example, the second reverse speed CS2 may be set to −2000 RPM.

According to an embodiment of the present invention, the control unit 105 is configured to determine the presence of washing fluid inside the sump 124 (filled condition) when the electric current I drawn by the circulation pump 130—sensed by the pump sensor unit 190—during a third time period TP3 after the second time period TP2 is higher than the average current value IAV by a second hysteresis threshold ITH2 (block 942). According to an embodiment of the present invention, the second hysteresis threshold ITH2 is set to a value higher than the first hysteresis threshold ITH1. According to an embodiment of the present invention, the second hysteresis threshold ITH2 is higher than 10 mA and lower than 20 mA, such as for example 15 mA.

According to an embodiment of the present invention, the control unit 105 is then configured to cause the inlet valve 120 to switch to the closed condition, and to cause the circulation pump 130 to stop (block 944).

It is pointed out that controlling the circulation pump 130 to rotate in the backward direction at a too large reverse speed, such as at the second reverse speed CS2, may cause problems in case a water softening agent regeneration procedure has been recently carried out by the water softening system 195 without having been followed by a complete drain operation. Indeed, in this case, brine comprising salt is still present in the sump 124, and by running the circulation pump 130 to rotate in the backward direction at a too large reverse speed could cause salt being sprayed in the tub 110, soiling the walls of the latter and the baskets 132, 134, 136.

According to an embodiment of the present invention, this problem is solved by preventing the control unit 105 to cause the circulation pump 130 to rotate in the backward direction at the second reverse speed CS2 in case the water softening system 195 has been subjected to a water softening agent regeneration procedure and no drain of the washing fluid inside the sump 124 has been carried out after said water softening agent regeneration procedure.

Particularly, according to an embodiment of the present invention, after block 930, the control unit 105 checks if the water softening system 195 has been subjected to a water softening agent regeneration procedure and no drain of the washing fluid inside the sump 124 has been carried out after said a water softening agent regeneration procedure (block 950).

If no water softening agent regeneration procedure has been performed, or if after that a water softening agent regeneration procedure has been performed the washing fluid inside the sump 124 has been drained out through the drain outlet 162 (exit branch N of block 950), the operations flow proceeds as already described above, with the control unit 105 that causes the circulation pump 130 to rotate in the backward direction at the second reverse speed CS2 (block 940).

If instead the water softening system 195 has been subjected to a water softening agent regeneration procedure and no drain of the washing fluid inside the sump 124 has been carried out after said water softening agent regeneration procedure (exit branch Y of block 950), according to an embodiment of the present invention, the control unit 105 causes the inlet valve 120 to switch to the closed condition, and cause the circulation pump 130 to stop (block 960).

Then, according to an embodiment of the present invention, the washing fluid included in the sump 124 (comprising salt) is drained out from the dishwasher 100 (block 965), for example using the previously described drain to empty routine 270, and then the operation flows returns to block 902.

Inlet Valve Checking Routine 285

In general, according to an embodiment of the present invention, the inlet valve checking procedure 285 provides for opening the inlet valve 120 to load washing fluid into the tub 110 while the circulation pump 130 is operated to reach a first target flow rate TFR1, and then closing the inlet valve 120 when a saturation state of the circulation pump 130 is determined with the circulation pump 130 that is operating at the first target flow rate TFR1. At this point, the circulation pump 130 is controlled to operate at a second flow rate TFR2 higher than the first flow rate TFR1. If a starvation state of the circulation pump 130 is determined while the circulation pump 130 is operating at the second flow rate TFR2, the inlet valve 120 is determined to not be affected by leakages when in the closed condition.

Figure 10A:
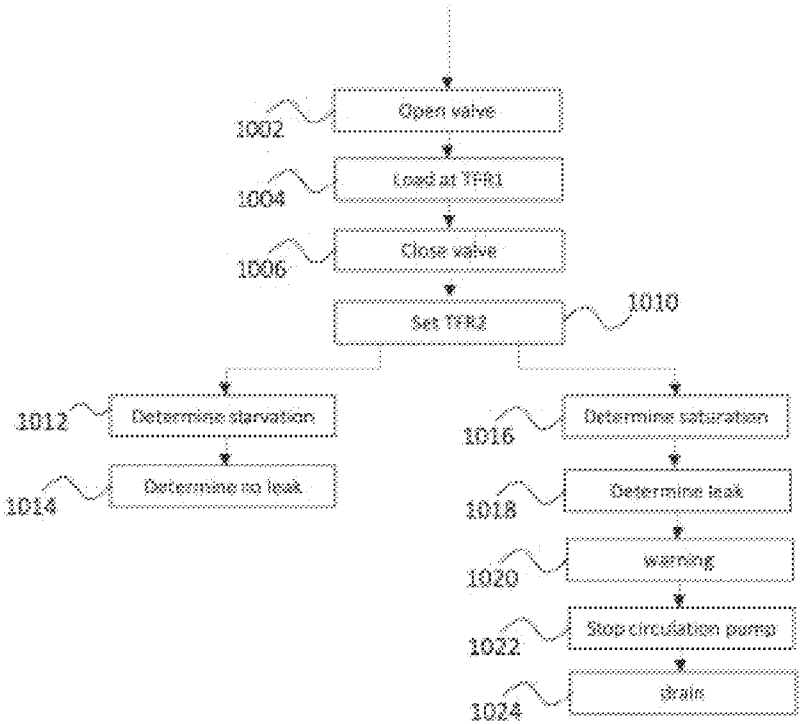
FIG. 10A illustrates in terms of functional blocks a flow chart depicting the operations carried out by the control unit of the dishwasher of FIG. 1 when an inlet valve checking routine is being carried out according to an embodiment of the present invention.

FIG. 10A illustrates in terms of functional blocks a flow chart depicting the operations carried out by the control unit 105 when the inlet valve checking routine 285 is being carried out according to an embodiment of the present invention.

According to an embodiment of the present invention, and starting from a condition in which the inlet valve 120 is in the closed condition, the control unit 105 controls the inlet valve to switch to the open condition for causing washing fluid to be fed into the tub 110 (block 1002).

According to an embodiment of the present invention, while washing fluid is fed into the tub 110 through the inlet valve 122, the control unit 105 controls the circulation pump 130 to operate for reaching a first target flow rate TFR1 (block 1004).

According to an embodiment of the present invention, the flow rate of the circulation pump 130 may be set by controlling the speed SC of the latter, and/or by selecting which spray devices 132, 134, 136 to connect (through the flow control device 140) to the circulation pump 130.

Particularly, if the speed SC of the circulation pump 130 is varied while maintaining a same spray condition SPC in which a same set of spray devices 132, 134, 136 is connected to the circulation pump 130, the higher the speed SC of the circulation pump 130, the higher the flow rate of the circulation pump 130.

Moreover, if the speed SC of the circulation pump 130 is maintained to a same value, the flow rate of the circulation pump 130 can be varied by altering the spray condition SPC of the spray devices 132, 134, 136. For example, the flow rate of the circulation pump 130 operating at a certain speed SC while connected to only the two spray devices 134, 136 is lower than the flow rate of the circulation pump 130 operating at the same speed SC when connected to all the three spray devices 132, 134, 136, since in the former spray condition SPC, only two spray devices 134, 136 need to be fed by the circulation pump 130, while in the latter spray condition SPC a higher number (3) of spray devices 132, 134, 136 need to be fed by the circulation pump 130. Similarly, the flow rate of the circulation pump 130 operating at a certain speed SC while connected to only the spray device 136 is lower than the flow rate of the circulation pump 130 operating at the same speed SC when connected to only the spray device 132, since in the latter spray condition SPC the washing fluid pumped by the circulation pump 130 has to reach an higher altitude (to reach the spray device 132) compared to the one corresponding to the former spray condition SPC (to reach the spray device 136).

According to an embodiment of the present invention, the control unit 105 controls the inlet valve 120 to switch to the closed condition (block 1006) when both the two following conditions are true:

- a saturation state of the circulation pump 130 is determined, and
- the circulation pump 130 is operating at (at least) the first target flow rate TFR1

In this way, the amount of washing fluid that has been loaded into the tub 110 with the operations corresponding to blocks 1002-1006 is sufficient to allow the circulation pump 130 to operate at the first target flow rate TFR1 without causing a starvation state of the circulation pump 130.

According to an embodiment of the present invention, the circulation pump 130 is operated by the control unit to reach the first target flow rate TFR1 by varying the speed SC of the circulation pump 130 to reach a corresponding first target speed TSC1. Advantageously, according to an embodiment of the present invention, this is carried out by having the control unit 105 that controls the speed SC of the circulation pump 130 according to the previously described controlled circulation routine 230 based on a target speed equal to the first target speed TSC1.

According to an embodiment of the present invention, the amount of washing fluid fed into the tub 110 sufficient to allow the circulation pump 130 to operate at the first target flow rate TFR1 without causing a starvation state of the circulation pump 130 corresponding to blocks 1004 and 1006 is set by having the control unit 105 that controls the inlet valve 120 according to the previously described fill to speed routine 240 based on a target speed equal to the first target speed TSC1. Therefore, according to an embodiment of the present invention, the control unit 105 is configured to control the inlet valve 120 to switch to the closed condition (block 1006) when the two following conditions are both true:

- a saturated state of the circulation pump 130 is determined, and
- a current speed SC of the circulation pump 130 is substantially equal to a circulation pump current speed equal to the first target speed TSC1 (e.g., when the current speed SC is equal to the first target speed TSC1±10%).

Moreover, since the fill to speed routine 240 according to the embodiments of the present invention provides that the inlet valve 120 is closed also before the speed SC reached the target speed if a starvation state of the circulation pump 130 is determined, intermediate closures and openings of the inlet valve 120 may occur after operations corresponding to block 1002 and before operations corresponding to block 1006.

Particularly, according to an embodiment of the present invention, the control unit 105 is configured to:

cause the inlet valve 120 to switch to the closed condition if a saturation state of the circulation pump 130 is determined while the current speed SC of the circulation pump 130 is lower than the first target speed TSC1;

cause the inlet valve 120 to switch back to the open condition if a starvation state of the circulation pump 130 is determined while the current speed SC of the circulation pump 130 is lower than the first target speed TSC1.

According to an embodiment of the present invention, after that the inlet valve 120 switched to the closed condition when a saturated state of the circulation pump 130 is determined, and a current speed SC of the circulation pump 130 is (at least) equal to a circulation pump current speed equal to the first target speed TSC1 (block 1006), the control unit 105 causes the circulation pump 130 to operate at a second target flow rate TFR2 higher than the first target flow rate TFR1 (block 1010). According to an embodiment of the present invention, the circulation pump 130 is controlled to operate at the second target flow rate TFR2 for a corresponding time period, such as for example for about 45 seconds.

According to an embodiment of the present invention, the control unit 105 controls the circulation pump 130 to operate at the second target flow rate TFR2 by causing the circulation pump 130 to increase its speed SC from the first target speed TSC1 to a second target speed TSC2 higher than the first target speed TSC1, and by keeping at the same time the spray devices 132, 134, 136 in a same spray condition SPC.

According to another embodiment of the present invention, the control unit 105 controls the circulation pump 130 to operate at the second target flow rate TFR2 by maintaining the speed SC of the circulation pump 130 at the first target speed TSC1 and by controlling at the same time the flow control device 140 to modify the spray condition SPC of the spray devices 132, 134, 136 with respect to the spray condition SPC employed during the execution of the operations corresponding to blocks 1002-1006. For example, according to an embodiment of the present invention, the operations corresponding to blocks 1002-1006 may be carried out by having the flow control device 140 that connects the circulation pump 130 to two spray devices (e.g., the spray devices 134 and 136), and the operations corresponding to block 1010 by having the flow control device 140 that connects the circulation pump 130 to all three spray devices 132, 134, 136.

The concepts of the present invention can be also applied in case the passage from the first target flow rate TFR1 to the second target flow rate TFR2 is accomplished by varying both the speed SC of the circulation pump 130 and the spray condition SPC of the spray devices 132, 134, 136.

According to an embodiment of the present invention, if a starvation state of the circulation pump 130 is determined (block 1012) while the circulation pump 130 is operating at the second target flow rate TFR2 (for example, when the circulation pump 130 is operating at the second target speed TSC2), the control unit 105 is configured to determine that the inlet valve 120 is not affected by leakages when the latter is in the closed condition (block 1014). Indeed, at the end of block 1006, the inlet valve 120 has been closed in such a way that the total amount of washing fluid loaded into the tub 110 is just sufficient to allow the circulation pump 130 to operate at the first target flow rate TFR1 without causing a starvation state of the circulation pump 130. If no additional washing fluid amount is then fed into the tub 110 after the closure of the inlet valve 120 at block 1006, when the circulation pump 130 is controlled to increase its flow rate to the second target flow rate TFR2 (block 1010), a starvation state determination is expected, since the amount of loaded washing fluid is insufficient for the requested increased second target flow rate TFR2.

According to an embodiment of the present invention, if no starvation state of the circulation pump 130 is determined (block 1016) while the circulation pump 130 is operating at the second target flow rate TFR2 (for example, a saturation state of the circulation pump 130 is still maintained after some time the circulation pump 130 is operating at the second target flow rate TFR2), the control unit 105 is configured to determine that the inlet valve 120 is affected by leakages when the latter is in the closed condition (block 1018). Indeed, if the inlet valve 120 did not correctly close itself at block 1006, and some washing fluid continue to leak into the tub 110 through the inlet valve 120 even after block 1006, the amount of washing fluid inside the tub 110 increases, allowing thus the circulation pump 130 to operate at the second target flow TFR2 without causing a starvation condition of the circulation pump 130.

In this way, it is possible to efficiently determine possible fault conditions of the inlet valve 120 (causing undesired leakages into the tub 110 when the inlet valve 120 is in the closed condition) even if the dishwasher is lacking of a pressure sensor for the determination of the level of washing fluid inside the tub 110.

According to an embodiment of the present invention, if the control unit 105 determined that the inlet valve 120 is affected by leakages when in the closed condition, the control unit is configured to generate a proper warning (block 1020), for example through an acoustic message, a visual message on a display of the dishwasher, or a warning message sent (e.g., through the Internet) to a smartphone of an user of the dishwasher 100.

According to an embodiment of the present invention, if the inlet valve 120 is determined to be affected by leakages when in the closed condition, the control unit 105 stops the circulation pump 130 (block 1022) and then drains the washing fluid out from the tub 110 by causing the drain pump 160 to switch to the activated condition for a predetermined time period ITP (block 1024).

According to an embodiment of the present invention, at least the operations corresponding to blocks 1002-1010 can be reiterated at least once after the predetermined time period ITP is expired.

According to an embodiment of the present invention, the control unit 105 is configured to carry out the operations corresponding to block 1022 and 1024 after each reiteration of the operations corresponding to blocks 1002-1010.

The inlet valve checking routine 285 according to the embodiments of the invention illustrated in FIG. 10A does not provide for conditions in which the circulation pump 130 and the drain pump 160 are activated concurrently, and therefore it can be implemented both in the case in which the circulation pump 130 and the drain pump 160 are driven by respective different and independent motor systems (i.e., the motor systems 165 and 166), and in the case in which a single motor system is provided, configured to selectively drive the circulation pump 130 or the drain pump 160.

Figure 10B:
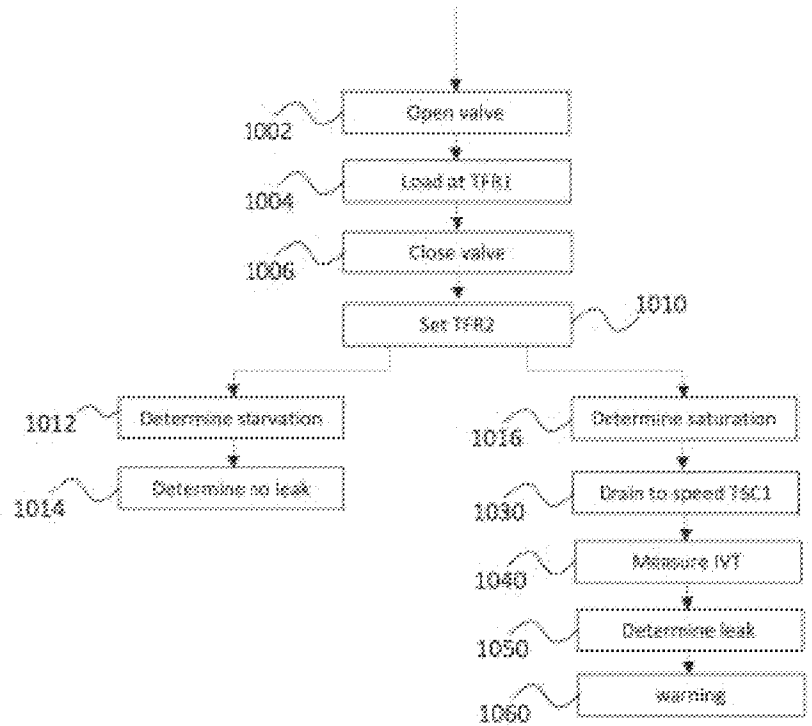
FIG. 10B illustrates in terms of functional blocks a flow chart depicting the operations carried out by the control unit of the dishwasher of FIG. 1 when an inlet valve checking routine is being carried out according to another embodiment of the present invention.

FIG. 10B illustrates in terms of functional blocks a flow chart depicting the operations carried out by the control unit 105 when the inlet valve checking routine 285 is being carried out according to another embodiment of the present invention, that can be implemented only in case the the circulation pump 130 and the drain pump 160 are driven by respective different and independent motor systems (i.e., the motor systems 165 and 166), and therefore they can be operated concurrently and independently. The operations of the inlet valve checking routine 285 according to the embodiment of the invention illustrated in FIG. 10B that are equal to the ones of the inlet valve checking routine 285 according to the embodiment of the invention illustrated in FIG. 10A will be identified with the same references, and their description will be omitted for the sake of conciseness.

The inlet valve checking routine 285 according to the embodiment of the invention illustrated in FIG. 10B differs from the inlet valve checking routine 285 according to the embodiment of the invention illustrated in FIG. 10A in that, after that no starvation state of the circulation pump 130 is determined while the circulation pump 130 is operating at the second target flow rate TFR2 (block 1016), the control unit 105 carries out a drain to speed routine 250 (block 1030) for carry out a partial drain of washing fluid from the washing tub 110 based on the first target speed TSC1. Particularly, according to an embodiment of the present invention, the control unit 105 provides for causing the drain pump 160 to switch from the deactivated condition to the activated condition and then for causing the drain pump 160 to switch from the activated condition to the deactivated condition when a starvation state of the circulation pump 130 is determined or when the following conditions are both true.

a saturated state of the circulation pump 130 is determined, and the current speed SC of the circulation pump 130 is lower than the the first target speed TSC1.

According to an embodiment of the present invention, the control unit 105 measures then a time IVT spent by the drain to speed routine 250 for draining an amount of washing fluid sufficient to fulfill both the two conditions above (block 1040).

Then, according to an embodiment of the present invention, the control unit 105 determines if the inlet valve 120 is affected by leakages when in the closed condition based on the measured time IVT (block 1050). According to an embodiment of the present invention, if the measured time IVT is higher than a threshold IVTH, it means that an additional amount of washing fluid entered in the tub 110 through the inlet valve 120 even after that the inlet valve 120 switched to the closed condition (the increased amount of washing fluid causing an increased duration of the drain operation), and therefore the control unit 105 determines that the inlet valve 120 is affected by leakages when in the closed condition. In this case, according to an embodiment of the present invention, the control unit is configured to generate a proper warning (block 1060), for example through an acoustic message, a visual message on a display of the dishwasher, or a warning message sent to a smartphone of an user of the dishwasher 100

According to an embodiment of the present invention, at least the operations corresponding to blocks 1002-1010 can be reiterated at least once before carrying out the drain to speed routine 250 at block 1030.

According to an embodiment of the present invention, the control unit 105 is configured to carry out the operations corresponding to blocks 1030 and 1040 after each reiteration of the operations corresponding to blocks 1002-1010.

Naturally, in order to satisfy local and specific requirements, a person skilled in the art may apply to the solution described above many logical and/or physical modifications and alterations. More specifically, although the present invention has been described with a certain degree of particularity with reference to preferred embodiments thereof, it should be understood that various omissions, substitutions and changes in the form and details as well as other embodiments are possible. In particular, different embodiments of the invention may even be practiced without the specific details set forth in the preceding description for providing a more thorough understanding thereof; on the contrary, well-known features may have been omitted or simplified in order not to encumber the description with unnecessary details. Moreover, it is expressly intended that specific elements and/or method steps described in connection with any disclosed embodiment of the invention may be incorporated in other embodiments.

The invention claimed is:

1. A washing appliance comprising:

a tub configured to house items to be washed;

an inlet valve operable to be selectively switched between an open condition for causing washing fluid to be loaded into the tub and a closed condition for preventing washing fluid be fed to the appliance;

a circulation pump configured to circulate the washing fluid in the tub during a washing cycle;

a control unit configured to determine an operative state of the circulation pump between (i) a saturation state indicative that sufficient washing fluid is present in the tub to prevent air from being drawn out by the circulation pump, and (ii) a starvation state indicative that insufficient washing fluid is present in the tub to prevent air from being drawn out by the circulation pump, wherein the control unit is further configured to receive an indication of a target speed for the circulation pump and control the circulation pump by:

causing a speed of the circulation pump to increase towards the target speed with a first speed increase rate;

and causing the speed of the circulation pump to increase towards the target speed with a second speed increase rate based on both of the following conditions a) and b) being met:

a) the starvation state of the circulation pump is determined before the speed of the circulation pump reaches the target speed, and b) the inlet valve is in the open condition, wherein the second speed increase rate is lower than the first speed increase rate.

2. The washing appliance of claim 1, wherein the control unit is configured to cause the speed of the circulation pump to decrease if condition a) is met while condition b) is not met.

3. The washing appliance of claim 2, wherein the control unit is configured to cause the speed of the circulation pump to increase towards the target speed with the second speed increase rate based on, in addition to both conditions a) and b) being met, an additional condition in which the saturation state of the circulation pump is not determined during a predetermined time period after the determination of the starvation state of the circulation pump.

4. The washing appliance of claim 1, wherein the control unit is configured to cause the speed of the circulation pump to increase towards the target speed with the second speed increase rate based on, in addition to both conditions a) and b) being met, an additional condition in which the saturation state of the circulation pump is not determined during a predetermined time period after the determination of the starvation state of the circulation pump.

5. The washing appliance of claim 1, wherein the control unit is configured to cause the speed of the circulation pump to increase towards the target speed with a third speed increase rate based on a condition c) in which the saturation state is determined during a predetermined time period after the starvation state of the circulation pump is determined, wherein the third speed increase rate is lower than the first speed increase rate and higher than the second speed increase rate.

6. The washing appliance of claim 5, wherein the control unit is configured to cause the speed of the circulation pump to increase towards the target speed with the third speed increase rate based on condition a) and condition c) being met.

7. The washing appliance of claim 6, wherein the third speed increase rate is equal to:

a first value if the inlet valve is in the open condition; and a second value lower than the first value if the inlet valve is in the closed condition.

8. The washing appliance of claim 5, wherein the third speed increase rate is equal to:

a first value if the inlet valve is in the open condition; and a second value lower than the first value if the inlet valve is in the closed condition.

9. The washing appliance of claim 8, wherein:

the first speed increase rate is higher than 70 RPM/s;

the second speed increase rate is lower than 10 RPM/s;

the first value of the third speed increase rate is higher than 50 RPM/s; and the second value of the third speed increase rate is lower than 50 RPM/s.

10. The washing appliance of claim 1 wherein the target speed depends on a user-selected washing cycle being carried out by the washing appliance and/or by a phase of the user-selected washing cycle being carried out by the washing appliance.

11. The washing appliance of claim 1, wherein:

the first speed increase rate is higher than 70 RPM/s; and the second speed increase rate is lower than 10 RPM/s.

12. The washing appliance of claim 1, wherein the washing appliance is a dishwasher comprising:

at least one basket provided in the tub for accommodating the items to be washed; and a set of spray devices for receiving washing fluid from the circulation pump and for spraying the received washing fluid into the tub.

13. A dishwasher comprising:

a tub;

an inlet valve operable to be selectively switched between an open condition for causing washing fluid to be loaded into the tub and a closed condition for preventing washing fluid be fed to the appliance;

a circulation pump configured to circulate the washing fluid in the tub during a washing cycle;

a control unit configured to determine an operative state of the circulation pump between (i) a saturation state indicative that sufficient washing fluid is present in the tub to prevent air from being drawn out by the circulation pump, and (ii) a starvation state indicative that insufficient washing fluid is present in the tub to prevent air from being drawn out by the circulation pump, wherein the control unit is further configured to receive an indication of a target speed for the circulation pump and control the circulation pump by:

causing a speed of the circulation pump to increase towards the target speed with a first speed increase rate;

and causing the speed of the circulation pump to increase towards the target speed with a second speed increase rate based on both of the following conditions a) and b) being met:

a) the starvation state of the circulation pump is determined before the speed of the circulation pump reaches the target speed, and b) the inlet valve is in the open condition, wherein the second speed increase rate is lower than the first speed increase rate.

14. The dishwasher of claim 13, wherein the control unit is configured to cause the speed of the circulation pump to decrease if condition a) is met while condition b) is not met.

15. The dishwasher of claim 14, wherein the control unit is configured to cause the speed of the circulation pump to increase towards the target speed with the second speed increase rate based on, in addition to both conditions a) and b) being met, an additional condition in which the saturation state of the circulation pump is not determined during a predetermined time period after the determination of the starvation state of the circulation pump.

16. The dishwasher of claim 15, wherein the control unit is configured to cause the speed of the circulation pump to increase towards the target speed with a third speed increase rate based on a condition c) in which the saturation state is determined during a predetermined time period after the starvation state of the circulation pump is determined, wherein the third speed increase rate is lower than the first speed increase rate and higher than the second speed increase rate.

17. The dishwasher of claim 16, wherein the control unit is configured to cause the speed of the circulation pump to increase towards the target speed with the third speed increase rate based on condition a) and condition c) being met.

18. The dishwasher of claim 17, wherein the third speed increase rate is equal to:

a first value if the inlet valve is in the open condition; and a second value lower than the first value if the inlet valve is in the closed condition.

19. The dishwasher of claim 13, wherein the control unit is configured to cause the speed of the circulation pump to increase towards the target speed with the second speed increase rate based on, in addition to both conditions a) and b) being met, an additional condition in which the saturation state of the circulation pump is not determined during a predetermined time period after the determination of the starvation state of the circulation pump.

20. The dishwasher of claim 13, wherein the target speed depends on a user-selected washing cycle being carried out by the washing appliance and/or by a phase of the user-selected washing cycle being carried out by the washing appliance.

* * * * *